US012553655B2

(12) United States Patent
Pagnozzi et al.

(10) Patent No.: US 12,553,655 B2
(45) **Date of Patent: *Feb. 17, 2026**

(54) APPLIANCE WITH DUAL ICE MAKERS

(71) Applicant: ELECTROLUX DO BRASIL S.A., Curitiba (BR)

(72) Inventors: Rodrigo Marge Pagnozzi, Curitiba (BR); Israel Mercer Neto, Curitiba (BR); Guilherme Rissatto Picanço, Curitiba (BR); Augusto Biscaia Da Silva, Curitiba (BR); Alexandre Sauer, Curitiba (BR); Alcione Colecha, Curitiba (BR); Aguilar Da Silva, Curitiba (BR)

(73) Assignee: Electrolux do Brasil, S.A., Curitiba (BR)

( * ) Notice: Subject to any disclaimer, the term of this patent is extended or adjusted under 35 U.S.C. 154(b) by 0 days.

This patent is subject to a terminal disclaimer.

(21) Appl. No.: 18/820,401

(22) Filed: Aug. 30, 2024

(65) Prior Publication Data

US 2024/0426536 A1 Dec. 26, 2024

Related U.S. Application Data

(62) Division of application No. 17/638,042, filed as application No. PCT/BR2019/050371 on Sep. 4, 2019, now Pat. No. 12,163,720.

(51) Int. Cl.
*F25C 5/20* (2018.01)
*F25C 1/24* (2018.01)
(Continued)

(52) U.S. Cl.
CPC ..... *F25C 5/22* (2018.01); *F25C 1/25* (2018.01); *F25D 23/126* (2013.01); *F25C 1/24* (2013.01);
(Continued)

(58) Field of Classification Search
CPC ..... F25C 2400/06; F25C 1/24; F25C 5/22; F25D 2323/121
See application file for complete search history.

(56) References Cited

U.S. PATENT DOCUMENTS 10,126,037 B2 11/2018 Barrena
2006/0260333 A1 11/2006 Wetekamp et al.
(Continued)

FOREIGN PATENT DOCUMENTS

JP 2010096410 4/2010

OTHER PUBLICATIONS

Chinese Office Action (English translation) for application No. 201980100018.X dated Nov. 30, 2024, 13 pages.
(Continued)

*Primary Examiner* — Paul Alvare
(74) *Attorney, Agent, or Firm* — Chrisman Gallo Tochtrop LLC

(57) ABSTRACT

A refrigerator appliance includes a cabinet defining a first compartment and a second compartment, a primary ice maker mounted within the first compartment, and an auxiliary ice maker removably mounted within the second compartment for selectively adjusting an ice making capacity of the appliance. The appliance further includes a dispenser for dispensing water and ice pieces made by the primary ice maker.

7 Claims, 17 Drawing Sheets

(51) Int. Cl.
*F25C 1/25* (2018.01)
*F25D 23/12* (2006.01)

(52) U.S. Cl.
CPC ..... *F25C 2400/08* (2013.01); *F25C 2400/10* (2013.01); *F25C 2600/04* (2013.01); *F25C 2700/12* (2013.01)

(56) References Cited

U.S. PATENT DOCUMENTS

2007/0103940 A1 5/2007 Chung
2009/0126390 A1* 5/2009 Park ..... F25D 23/126 220/565
2009/0165492 A1 7/2009 Wilson et al.
2009/0277210 A1* 11/2009 Eveland ..... F25D 23/066 62/441
2010/0050681 A1* 3/2010 Ryu ..... F25D 11/022 62/344
2010/0126210 A1 5/2010 Rotter
2012/0023998 A1* 2/2012 Oh ..... F25C 5/22 62/340
2012/0111048 A1 5/2012 Kim et al.
2014/0150467 A1 6/2014 Boarman et al.
2014/0313328 A1 10/2014 Park et al.
2014/0313331 A1 10/2014 Kim
2014/0360219 A1 12/2014 Lee
2015/0330695 A1 11/2015 Miller
2016/0025406 A1* 1/2016 An ..... C02F 1/003 222/173
2016/0047591 A1* 2/2016 Jeong ..... F25D 21/00 62/340
2016/0116198 A1 4/2016 Becker
2018/0017308 A1* 1/2018 Yang ..... F25D 23/12
2018/0347714 A1* 12/2018 Griswold ..... F16K 11/24
2018/0347884 A1* 12/2018 Kang ..... F16K 11/24
2019/0011160 A1* 1/2019 Bertolini ..... F25C 5/08

OTHER PUBLICATIONS

International Search Report for PCT/BR2019/050371 dated Feb. 11, 2020, 2 pages.
Translation of JP Patent Document JP2010096410, 2010.

* cited by examiner

APPLIANCE WITH DUAL ICE MAKERS

CROSS-REFERENCE TO RELATED APPLICATIONS

This application is a divisional of U.S. application Ser. No. 17/638,042 filed on Feb. 24, 2022, which is a US National Phase of PCT/BR2019/050371 filed on Sep. 4, 2019. These applications are incorporated herein by reference.

FIELD OF THE INVENTION

This application relates generally to a refrigeration appliance, and more particularly, a refrigerator appliance with dual ice makers.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored, and the freezer compartment is where food items that are to be kept in a frozen condition are stored. The refrigerators are provided with a refrigeration system that maintains the fresh food compartment at temperatures above 0° C. and the freezer compartments at temperatures below 0° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. This unit is typically located in the freezer compartment of the refrigerator and prepares ice by convection, i.e., by circulating cold air over water in an ice tray to freeze the water into ice cubes. A storage bin for storing the frozen ice pieces is also often provided adjacent to the ice making unit. The ice pieces can be dispensed from the storage bin through a dispensing port in a door that closes the freezer to the ambient air. The dispensing of the ice usually occurs by means of an ice delivery mechanism that extends between the storage bin and the dispensing port in the freezer compartment door.

BRIEF SUMMARY OF THE INVENTION

The following presents a simplified summary of example embodiments of the invention. This summary is not intended to identify critical elements of the invention or to delineate the scope of the invention. The sole purpose of the summary is to present some example embodiments in simplified form as a prelude to the more detailed description that is presented later.

In accordance with one aspect, a refrigerator appliance includes a cabinet defining a first compartment and a second compartment, a primary ice maker mounted within the first compartment, and an auxiliary ice maker removably mounted within the second compartment for selectively adjusting an ice making capacity of the appliance. The appliance further includes a dispenser for dispensing water and ice pieces made by the primary ice maker.

In accordance with a second aspect, a refrigerator appliance includes a cabinet defining one or more compartments, a primary ice maker mounted within the one or more compartments, and a dispenser having a water outlet for dispensing water and an ice outlet for dispensing ice pieces made by the primary ice maker. The appliance further includes an auxiliary ice maker removably mounted within the one or more compartments, wherein the auxiliary ice maker includes a carriage and an ice mold movably coupled to the carriage such that the ice mold is movable between a home position and a harvest position. The auxiliary ice maker further includes a drive assembly that is operable to move the ice mold between its home position and harvest position, and a detection lever movably coupled to the carriage such that the detection lever is movable between a retracted position and an extended position, the detection lever being biased toward the extended position. Moreover, the auxiliary ice maker includes a self-contained control system having a controller configured to perform one or more operations with the auxiliary ice maker, a temperature sensor in communication with the controller, a sensor assembly configured to detect a predetermined position of the detection lever and provide an output to the controller indicating whether the detection lever is in the predetermined position, and a cable assembly that is electrically coupled to the controller. The appliance further includes a triple valve having a single input and three outputs, the single input being fluidly coupled to a water inlet of the appliance and the three outputs being fluidly coupled to the primary ice maker, the auxiliary ice maker, and the water outlet of the dispenser. The triple valve is operable to provide selective communication between the single input and each output. Moreover, the cable assembly of the auxiliary ice maker includes a power line in communication with a power inlet of the appliance and a control line in communication with the triple valve.

It is to be understood that both the foregoing general description and the following detailed description present example and explanatory embodiments. The accompanying drawings are included to provide a further understanding of the described embodiments and are incorporated into and constitute a part of this specification. The drawings illustrate various example embodiments.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION

Figure 1:
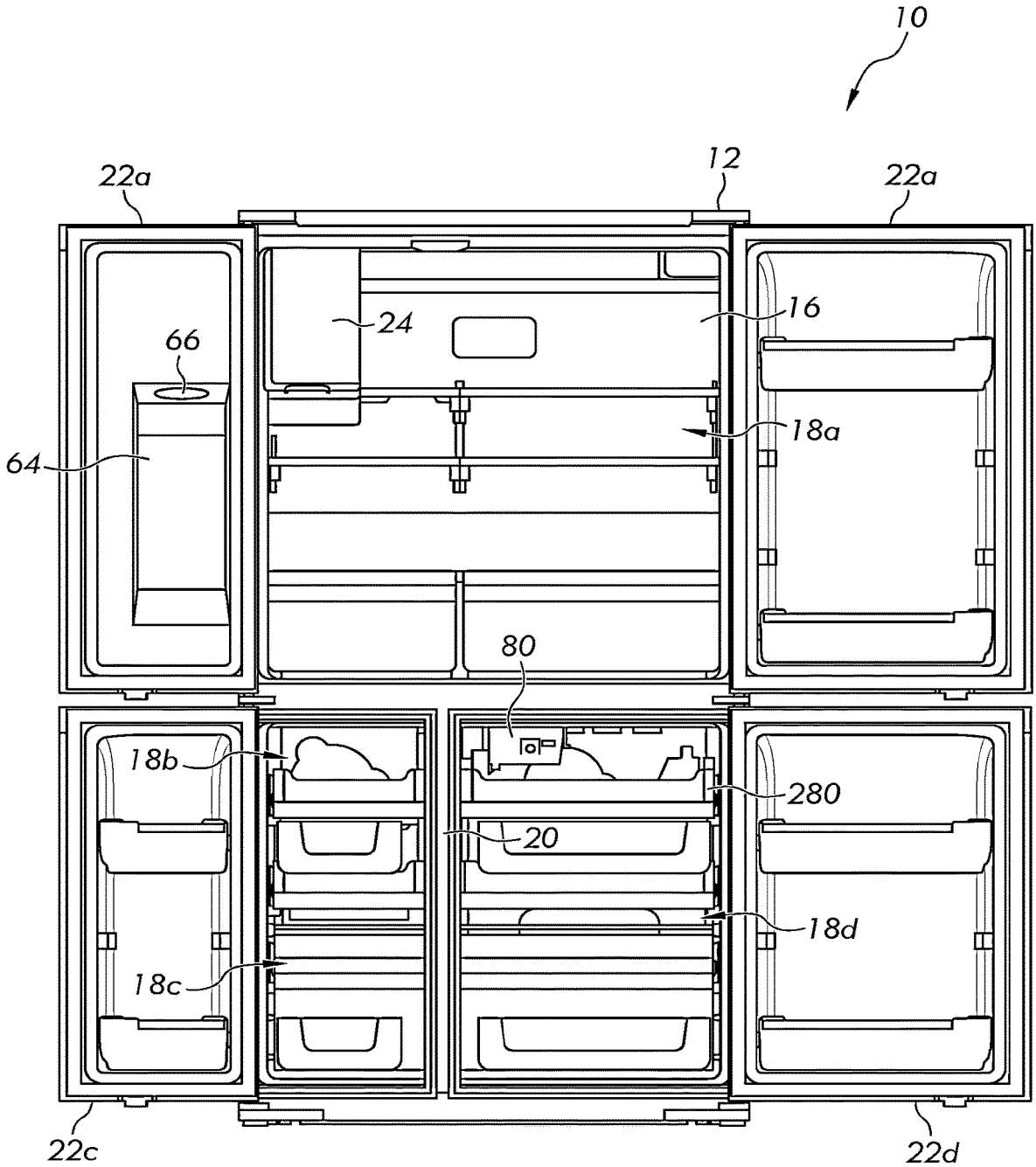
FIG. 1 is a front view of an example appliance.

Example embodiments are described and illustrated in the drawings. These illustrated examples are not intended to be a limitation on the present invention. For example, one or more aspects can be utilized in other embodiments and even other types of devices. Moreover, certain terminology is used herein for convenience only and is not to be taken as a limitation. Still further, in the drawings, the same reference numerals are employed for designating the same elements.

Referring to FIG. 1 an example refrigerator appliance 10 is illustrated having a cabinet 12 that includes an outer shell 14 and a liner 16 provided within the outer shell 14 that defines a plurality of compartments 18. In particular, the liner 16 defines an upper compartment 18*a* and a lower compartment 18*b*, the lower compartment 18*b* being divided by a mullion wall 20 into a lower-left compartment 18*c* and a lower-right compartment 18*d*.

The upper compartment 18*a* corresponds to a fresh-food compartment of the appliance 10, while the lower compartments 18*c*, 18*d* each correspond to a freezer compartment of the appliance 10. Alternatively, at least one of the compartments 18, such as compartment 18*c*, can be a variable temperature compartment (VCZ, also known as a convertible compartment) with a temperature that is user-selectable between fresh food and freezer temperatures (i.e., user selectable to be above-freezing or below-freezing).

The appliance 10 further includes a plurality of doors 22 attached to its cabinet 12 that can be opened and closed to provide selective access to its compartments 18. More specifically, the appliance 10 includes a pair of upper French doors 22*a* for providing selective access to the upper compartment 18*a*, a lower-left door 22*c* for providing selective access to the lower-left compartment 18*c*, and a lower-right door 22*d* for providing selective access to the lower-right compartment 18*d*. Each door 22 is pivotally attached to the cabinet 12 such that the door 22 is rotatable between its open and closed positions. Alternatively, one or more of the doors 22 can form a drawer that is slidable with respect to its compartment 18.

The appliance 10 can include any number, type, and arrangement of liners 16, compartments 18, and doors 22 without departing from the scope of the disclosure. Insulation can be provided between the liner(s) 16 and outer shell 14 to insulate the compartment(s) 18 of the appliance 10. Moreover, the appliance 10 can include a refrigeration system (e.g., condenser, evaporator, compressor, air circulation system, etc.) that can maintain its fresh food compartment(s) 18 at temperature(s) between 0° C. and 4.5° C., and its freezer compartment(s) 18 at temperature(s) below 0° C.

Figure 2:
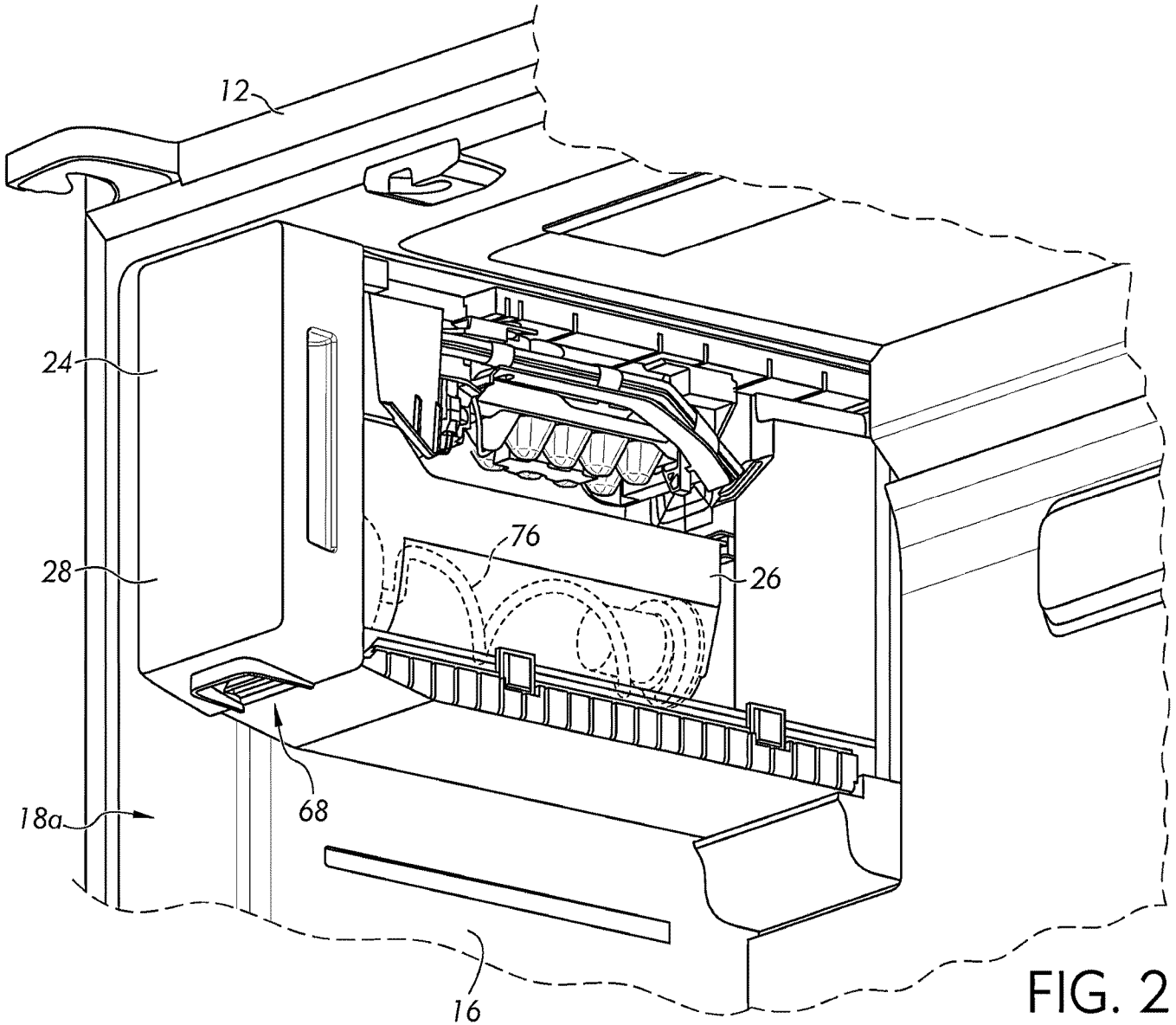
FIG. 2 is a perspective view of a primary ice maker of the appliance.

As shown in FIG. 2, the appliance 10 can include a primary ice maker 24 for making ice pieces, and an ice bin 26 for collecting ice pieces made by the ice maker 24. Generally speaking, the ice maker 24 and ice bin 26 can comprise any configuration for respectively making and storing ice pieces. For instance, example configurations of these features are disclosed in detail in U.S. Pat. No. 9,234,690, which is incorporated herein by reference in its entirety.

In the illustrated embodiment, the ice maker 24 is mounted in an upper-left corner of the upper compartment 18*a*, and the ice bin 26 is arranged within a housing 28 of the ice maker 24 (for the purposes of illustration, the housing 28 in FIG. 2 is shown with a side panel of the housing 28 removed in order to view an interior of the housing 28). However, the ice maker 24 and ice bin 26 can be arranged within other compartments 18 of the appliance 10 in other examples, and the ice bin 26 may be arranged external to the ice maker 24 in some examples.

Figure 3:
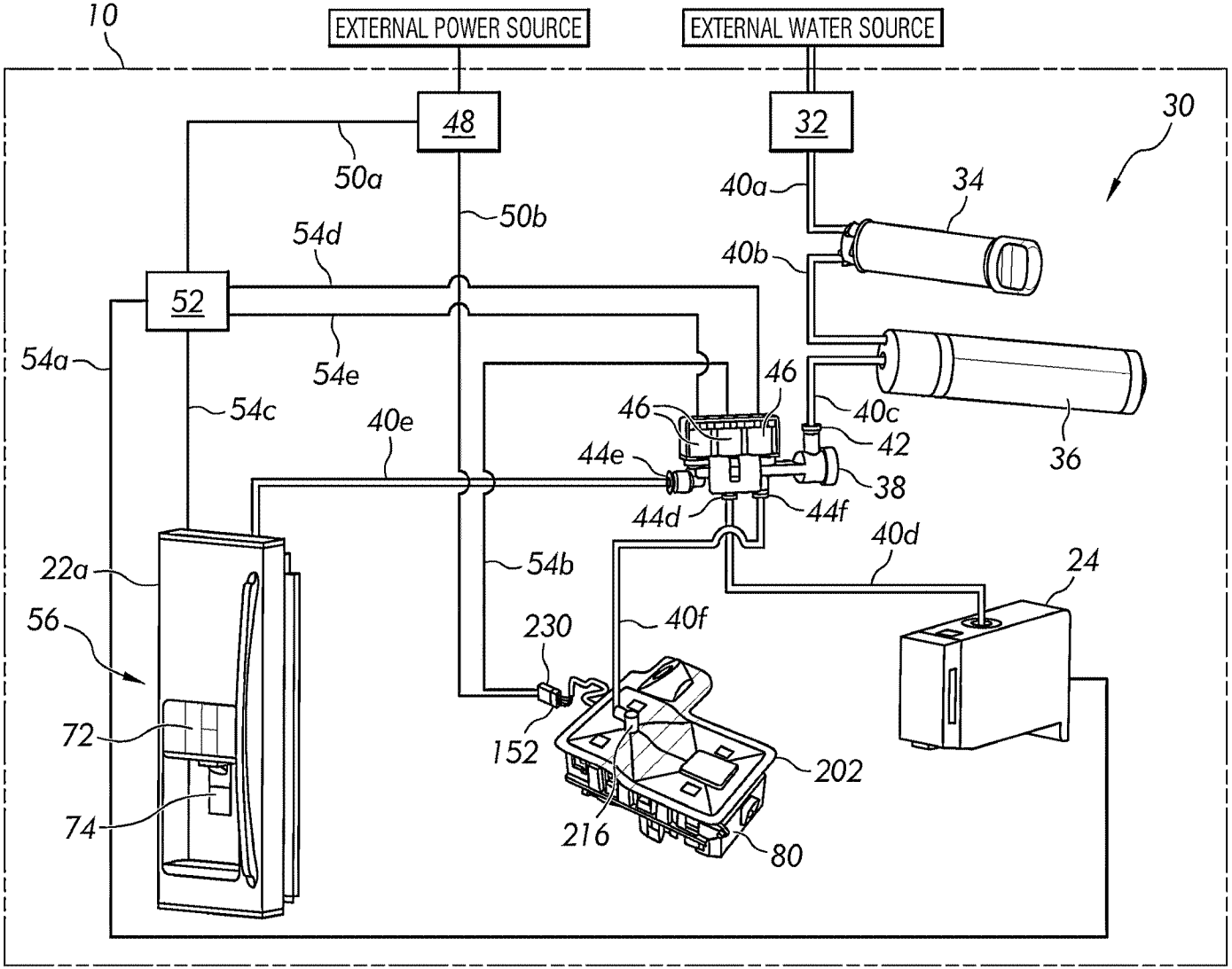
FIG. 3 is a schematic view showing water, power, and control lines of the appliance.

Turning to FIG. 3, the appliance 10 can include a water supply system 30 for supplying water to the primary ice maker 24 and other components of the appliance 10. The water supply system 30 can include a water inlet 32 (e.g., pipe fitting) for receiving water from an external water source, a water filter 34, a water storage tank 36, one or more valves 38, and a plurality of water lines 40 (e.g., tubes, pipes, etc.) for providing fluid communication between components. In the illustrated embodiment, the water filter 34 is connected downstream of the water inlet 32 via water line 40*a*, the water storage tank 36 is connected downstream of the water filter 34 via water line 40*b*, and a single valve 38 is connected downstream of the water storage tank 36 via water line 40*c*. Optionally, the water filter and/or the storage tank may not be used.

The valve 38 in the illustrated embodiment is a "triple valve" having a single input 42 and three outputs 44*e-f* that are fluidly coupled to respective features of the appliance 10 via water lines 40*d-f*. For example, one output 44*d* of the valve 38 is fluidly coupled to the primary ice maker 24 via water line 40*d*. The valve 38 further comprises three solenoids 46 that are each associated with a corresponding output 44 of the valve 38 and can be independently operated to provide selective communication between the input 42 and the solenoid's associated output 44. In this manner, the solenoids 46 can be operated to provide selective communication between the input 42 and any one or more of the outputs 44 as desired.

It is to be appreciated that the components of the water supply system 30 can be arranged in alternative manners in other examples. Moreover, the water supply system 30 can include additional components (e.g., valves, water lines, pressure regulators) than those illustrated, and/or can exclude one or more of the illustrated components.

As further shown in FIG. 3, the appliance 10 can include a power inlet 48 (e.g., power cable) for receiving power (e.g., AC power) from an external power source and supplying that power to various components of the appliance 10 via one or more power lines 50. Moreover, the appliance can include a central controller 52 (e.g., microcontroller, PLC) that can control its components via one or more control lines 54. For example, the power inlet 48 in the illustrated embodiment can provide power to the controller 52 via power line 50, which in turn can control the primary ice maker 24 via control line 54*a*.

Figure 4:
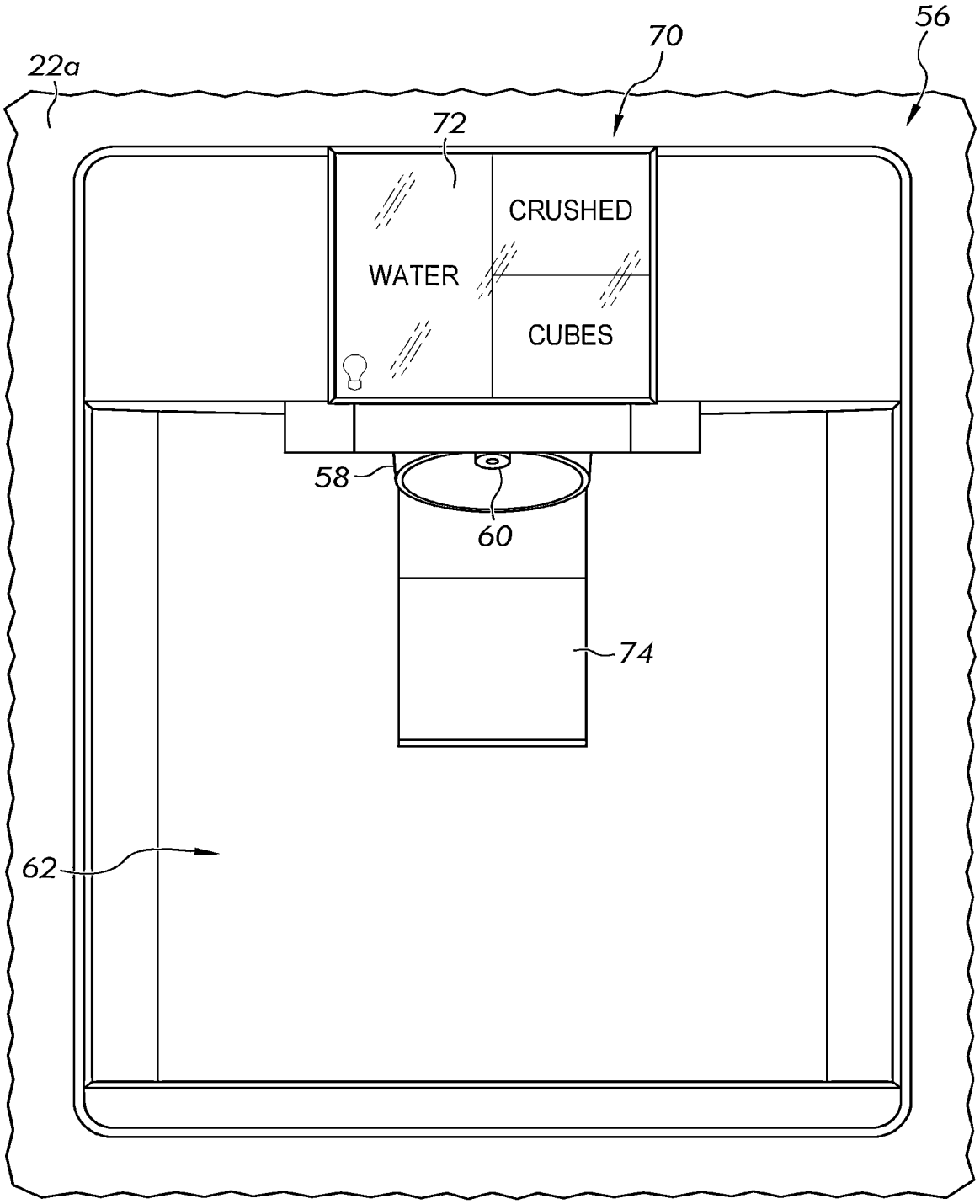
FIG. 4 is a front view of a dispenser of the appliance.

Turning to FIG. 4, the appliance 10 can further include a dispenser 56 for dispensing water and/or ice pieces made by the ice maker 24, an example of which is also disclosed in the '690 patent. The dispenser 56 in the illustrated embodiment is configured to dispense both water and ice pieces, as discussed below.

More specifically, the dispenser 56 in the illustrated embodiment includes an ice outlet 58 and a water outlet 60 disposed within a dispenser cavity 62 of the upper-left door 22*a*. The water outlet 60 is in fluid communication with the valve 38 of the water supply system 30 via water line 40*e* (see FIG. 3). Meanwhile, the ice outlet 58 is in communication with an ice chute 64 (see FIG. 1) that extends through the door 22*a* and has an inlet 66 that will align with an aperture 68 formed along a bottom surface of the ice maker's housing 28 when the door 22*a* is in its closed position.

The dispenser 56 in the illustrated embodiment further includes a user interface 70 that a user can interact with to dispense ice pieces or water through its associated outlet. More specifically, the user interface 70 includes a user input feature, such as various electrical buttons or switches, a touchscreen, capacitive touch buttons 72, etc. and an actuator 74 that are in communication with a central controller 52 of the appliance 10. The touch buttons 72 enable a user to select which item should be dispensed (i.e., water, crushed ice, or cubed ice). Meanwhile, the actuator 74 is a lever mounted within the dispenser cavity 62 that when pressed will cause the selected item to be dispensed.

When water is selected and the actuator 74 is pressed, the central controller 52 will operate the water supply system 30 to supply water to the water outlet 60 of the dispenser 56. Meanwhile, when crushed or cubed ice is selected and the actuator 74 is pressed, the controller 52 will operate (i.e., rotate) an auger 76 within the ice bin 26 of the primary ice maker 24 (see FIG. 2), which will urge ice pieces stored in the ice bin 26 through the aperture 68 of the ice maker's housing 28 into the ice chute 64. The ice pieces will then fall through the ice chute 64 and be dispensed through the ice outlet 58 into the dispenser cavity 62. If crushed ice in particular is selected, an ice crushing mechanism (not shown) will crush the ice pieces as they fall through the ice chute 64.

It is to be appreciated that the dispenser 56 can comprise a variety of alternative configurations for dispensing water and/or ice pieces without departing from the scope of the disclosure. For instance, the user interface 70 can comprise additional and/or alternative structure (e.g., buttons, switches, proximity sensors, etc.) that a user can interact with to dispense ice pieces or water through its associated outlet. As another example, the dispenser 56 can be arranged on a different door 22 of the appliance 10.

Turning to FIGS. 5-8, an example auxiliary ice maker 80 will now be described that can be removably mounted in a compartment 18 of the appliance 10 to selectively adjust an ice making capacity of the appliance 10 as desired. Preferably, the auxiliary ice maker 80 is mounted in a separate compartment from the primary ice maker 24, and is used to augment the amount of ice available to the user. More preferably, the auxiliary ice maker 80 is mounted in a freezer compartment where it is exposed to below-freezing air.

Figure 5:
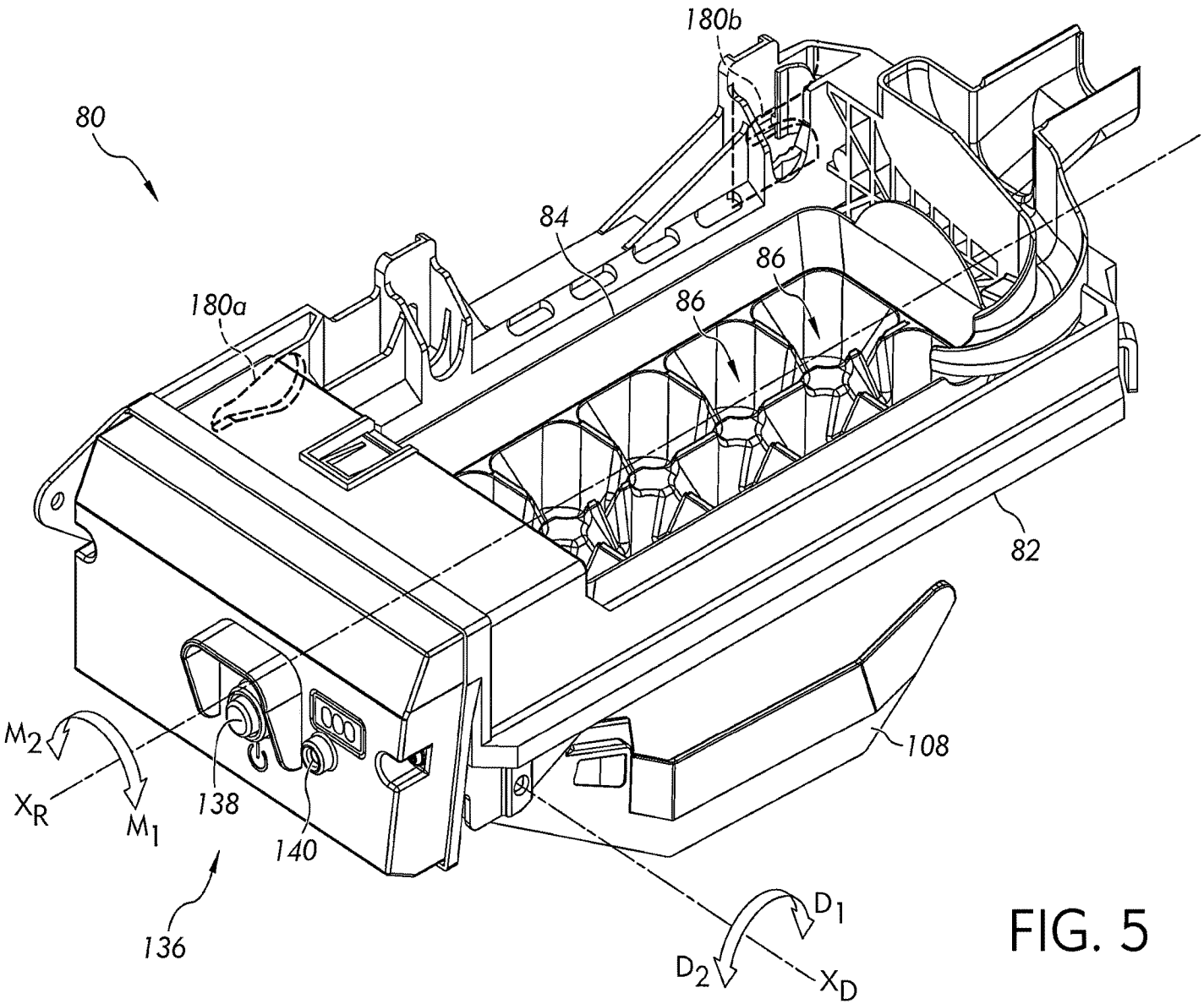
FIG. 5 is a perspective view of an auxiliary ice maker of the appliance.
Figure 6:
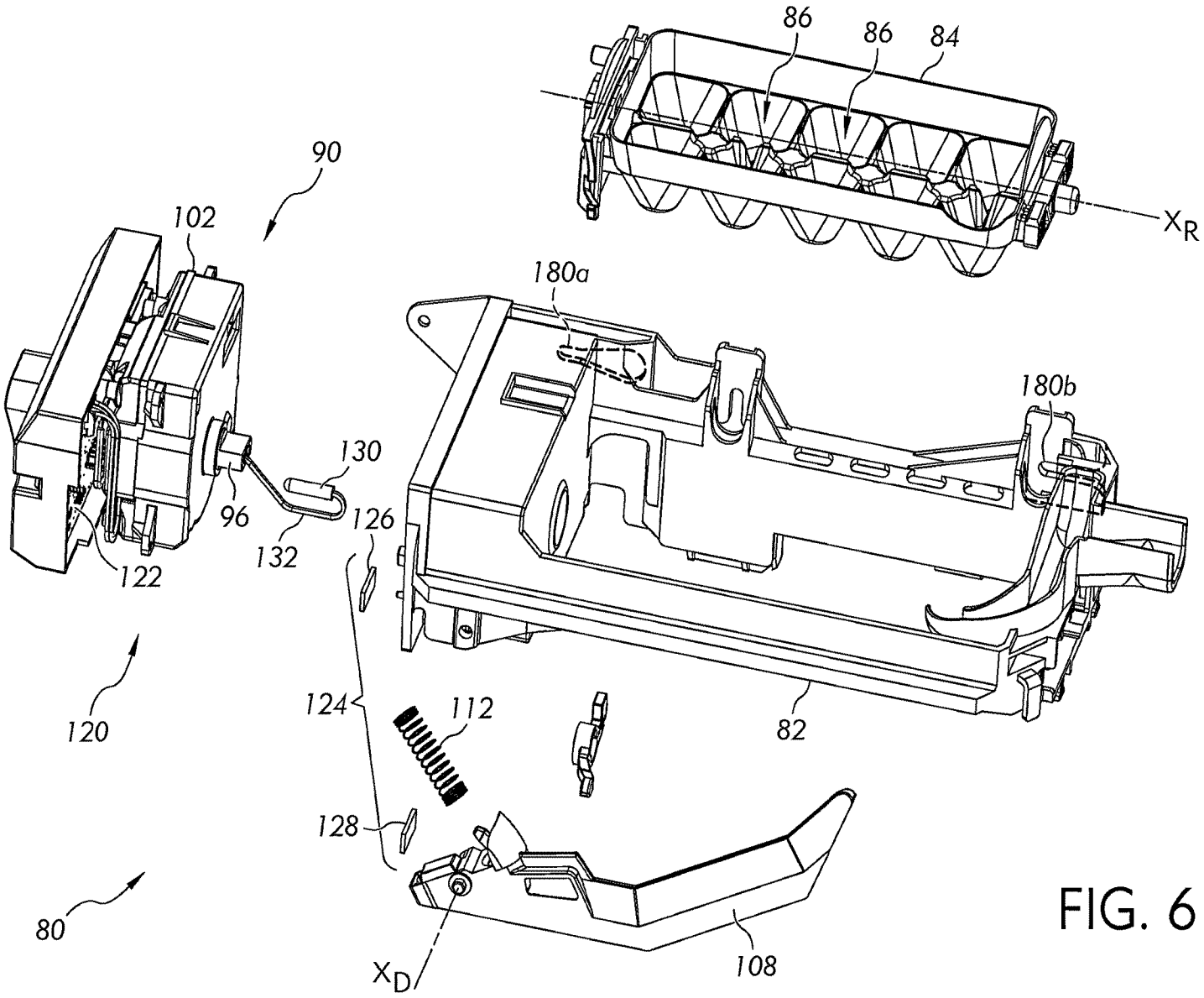
FIG. 6 is an exploded view of the auxiliary ice maker.

As shown in FIGS. 5 & 6, the ice maker 80 includes a carriage 82 and an ice mold 84 movably coupled to the carriage 82. The ice mold 84 defines a plurality of cavities 86 such that water can be poured into the cavities 86 and then frozen to form ice. The number and shape of the cavities 86 can vary by embodiment.

The ice mold 84 is movably coupled to the carriage 82 such that the ice mold 84 is movable relative to the carriage 82 between a plurality of positions. For example, the ice mold 84 in the illustrated embodiment is rotatably coupled to carriage 82 such that the ice mold 84 is rotatable about the axis XR. In particular, the ice mold 84 in FIG. 5 is shown in a "home position", which corresponds to a position in which ice will be formed in the ice mold 84. The ice mold 84 can be rotated about the axis XR in a first direction M1 to a "harvest position", which corresponds to a position in which ice will be harvested from the ice mold. The ice mold 84 can then be rotated about the axis XR in an opposite direction M2 back to the home position for making more ice.

The degree to which the ice mold 84 rotates about the axis XR from its home position to the harvest position can vary in embodiments. Moreover, the ice mold 84 may be rotatable about other axes or movable in other manners (e.g., tilting, sliding, etc.) between its home and harvest positions. Still further, the home position and/or harvest position may be positioned differently than as described and illustrated herein. Broadly speaking, the home and harvest positions can be any two different positions relative to the carriage 82, and the ice mold 84 can be movable in a variety of different manners between the two positions.

Figure 7:
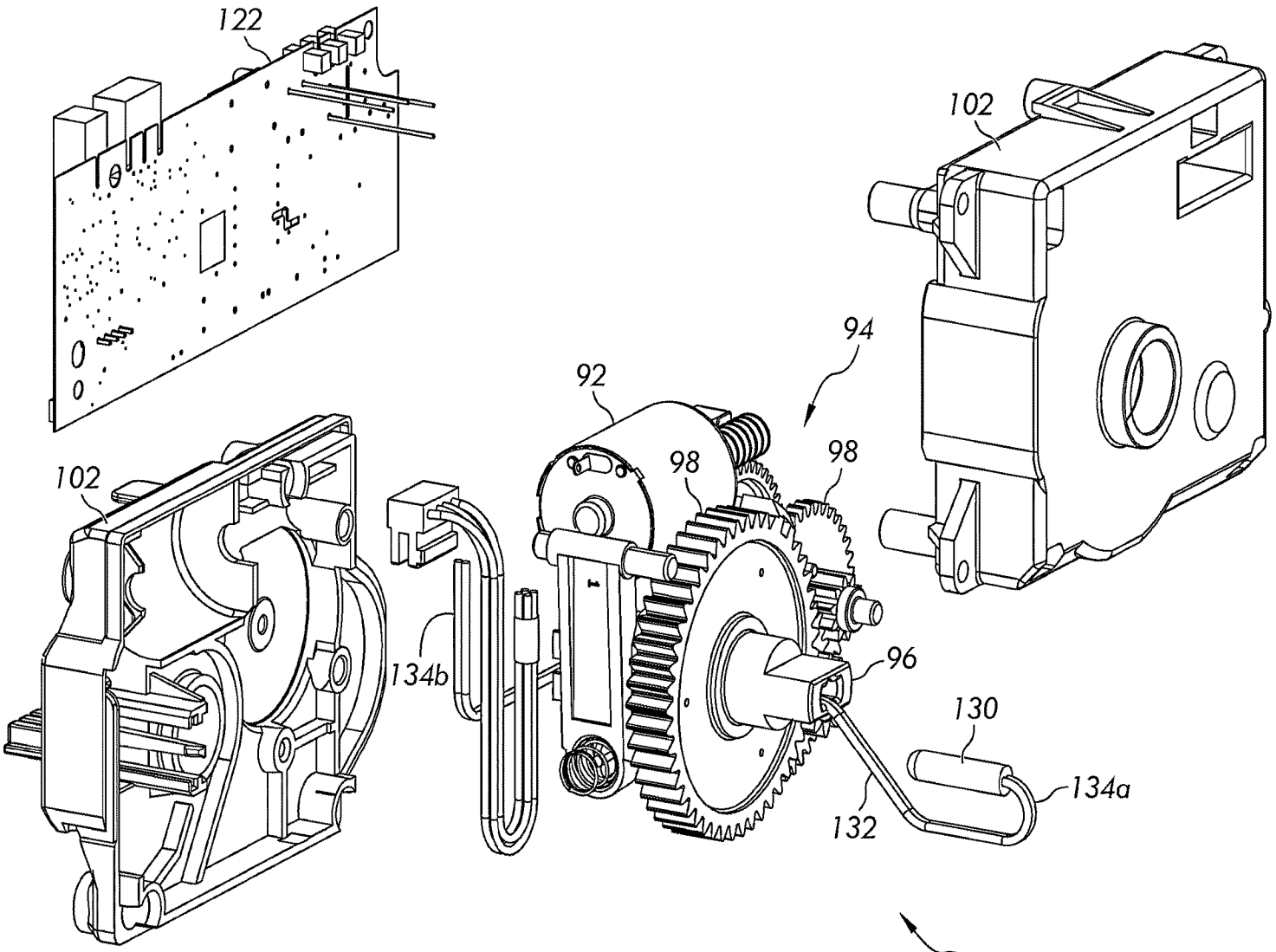
FIG. 7 is an exploded view of a drive assembly and various control elements of the auxiliary ice maker.

The ice maker 80 can include a drive assembly 90 that is operable to move the ice mold 84 between its home and harvest positions. As shown in FIG. 7, the drive assembly 90 in the present embodiment includes a motor 92 (e.g., DC motor) and a transmission 94 that operatively couples the motor 92 to the ice mold 84. In particular, the transmission 94 has a drive shaft 96 that is coupled to the ice mold 84, and one or more gears 98 that operatively couple the motor 92 to the drive shaft 96. Moreover, a housing 102 is fixed to the carriage 82 that encloses and supports the motor 92 and gears 98. In this manner, the motor 92 can be operated to rotate the drive shaft 96 via the gears 98 and rotate the ice mold 84 accordingly. However, the drive assembly 90 can comprise a variety of additional and/or alternative features and configurations for moving the ice mold 84 between its home and harvest positions.

The ice maker 80 can further include a detection lever 108 (see FIGS. 5 & 6) that is movably coupled to the carriage 82 and can indicate the presence or absence of ice previously harvested from the ice maker 80, which in turn can be useful for determining whether additional ice should be made and harvested. This can be referred to as a "bale arm" or "ice level arm". For example, the detection lever 108 in the present embodiment is pivotally mounted to the carriage 82 such that the detection lever 108 can be rotated about an axis XD between a retracted position and an extended position. The detection lever 108 is shown in FIG. 5 in the retracted position, and the extended position is assumed by rotating the detection lever 108 from the retracted position in a first direction D1 a predetermined angular distance that is between 25° and 45°, and more preferably between 30° and 40°, and still more preferably about 35°. However, other angular distances are possible in other embodiments.

The detection lever 108 can be biased toward the extended position by a variety of different means. For example, the detection lever 108 can be biased by gravity toward the extended position, and/or the ice maker 80 can include a spring 112 that is configured to bias the detection lever 108 toward the extended position. In particular, the spring 112 can be configured such that the spring 112 is compressed when the detection lever 108 assumes the retracted position and pushes the detection lever 108 toward the extended position. Alternatively, the spring 112 can be configured such that the spring 112 is tensioned when the detection lever 108 assumes the retracted position and pulls the detection lever 108 toward the extended position.

When the ice maker 80 is mounted in a compartment 18 of the appliance 10, an ice bin can be provided below the ice maker 80 to collect and store ice pieces made by the ice maker 80. As the ice pieces collect in the ice bin, the buildup of ice pieces can physically impede the detection lever 108 from assuming its extended position, causing the detection lever 108 to remain in its retracted position or some other position intermediate the retracted and extended positions. Thus, the retracted and intermediate positions of the detection lever 108 can indicate a state in which a sufficient amount of ice is stored in the ice bin and no further ice needs to be made and harvested. Conversely, the extended position of the detection lever 108 can indicate a state in which little or no ice is stored in the bin and more ice should be made and harvested.

It is to be appreciated that the detection lever 108 can be movably coupled to the carriage 82 in a variety of different manners such that the detection lever 108 is indicative of the presence or absence of ice previously harvested. For example, the detection lever 108 may be rotatable about other axes, or may be translatable in a linear direction (e.g., up/down) between its retracted and extended positions. Moreover, the detection lever 108 can comprise alternative shapes and sizes than that illustrated. The detection lever 108 can take on any form that is movable between retracted and extended positions, the positions being indicative of the presence or absence of ice previously harvested.

The ice maker 80 can further include a control system 120 (see FIG. 6) for sensing and controlling various aspects of the ice maker 80. The control system 120 can include a programmable controller 122 (e.g., microcontroller, PLC, etc.) that is operatively coupled to the drive assembly 90 (e.g., electrically coupled to the motor 92) and programmed to perform one or more operations, as will be described later below. The control system 120 can further include a sensor assembly 124 that is configured to detect a predetermined position (e.g., the extended position or retracted position) of the detection lever 108 and provide an output to the controller 122 indicating whether the detection lever 108 is in the predetermined position.

For instance, in the illustrated embodiment, the sensor assembly 124 includes a sensor 126 in the form of a Hall Effect switch that is fixed to the carriage 82. The sensor 126 includes a pair of contacts that are electrically coupled to the controller 122 and normally biased open (e.g., via ferromagnetic metal reeds). When the contacts are closed, the sensor 126 will complete a circuit with the controller 122 and output a positive signal to the controller 122 indicating that the switch is closed. When the contacts are opened, the circuit will be broken and the sensor 126 will output a zero signal to the controller 122 indicating that the switch is open.

The sensor assembly 124 in the illustrated embodiment further includes an actuation member 128 in the form of a magnetic body that is fixed to the detection lever 108. The magnetic body produces a magnetic field that is configured to close the sensor's pair of contacts when within a certain vicinity of the sensor 126. In particular, the sensor 126 and actuation member 128 are arranged on the carriage 82 and detection lever 108 such that the actuation member 128 will engage the sensor 126 when the detection lever 108 is in its extended position, thereby closing the contacts of the sensor 126 and outputting a positive signal to the controller 122 indicating that the detection lever 108 is in its extended position. Meanwhile, when the detection lever 108 is away from the extended position (e.g., in the retracted position), the actuation member 128 will not engage the sensor 126, and the sensor 126 will output a zero signal to the controller 122 indicating that the detection lever 108 is not in the extended position.

Thus, the sensor assembly 124 in the illustrated embodiment is configured to detect a predetermined position corresponding to the extended position of the detection lever 108, and will provide an output (i.e., positive or zero signal) indicating whether the detection lever 108 is in the extended position. However, the sensor assembly 124 can be configured in a variety of different manners that can detect a predetermined position of the detection lever 108 and send an output indicating whether the detection lever 108 is in the predetermined position. For example, the sensor 126 can be fixed to the detection lever 108 and the actuation member 128 is fixed to the carriage 82. As another example, the sensor 126 and actuation member 128 can be configured to detect the retracted position of the detection lever 108. As yet another example, the sensor 126 can be configured to output a zero signal to the controller 122 when the detection lever 108 is in its predetermined position, and a positive signal when the detection lever 108 is not in its predetermined position.

In some examples, the control system 120 can include a temperature sensor 130 (e.g., thermistor, thermocouple, etc.) electrically coupled to the controller 122 that is configured to detect temperature. In the present embodiment, the temperature sensor 130 is a thermistor having a resistance that varies with temperature. Moreover, the control system 120 includes a wire assembly 132 (see FIG. 7) that is coupled at one end 134*a* to the temperature sensor 130 and is coupled at another end 134*b* to the controller 122 to electrically connect the controller 122 and temperature sensor 130. The wire assembly 132 enables the controller 122 to provide an electrical current through the temperature sensor 130 and determine the present resistance of the temperature sensor 130. In this manner, the temperature sensor 130 detects temperature by providing a resistance that corresponds to its temperature, and the controller 122 can monitor the temperature detected by the temperature sensor 130.

The control system 120 can further include a user interface 136 (see FIG. 5) that is operatively coupled to the controller 122 and is configured to enable interaction and communication between a user and the controller 122. For example, the user interface 136 can include one or more input elements 138 (e.g., buttons, switches, touchscreens, microphones, etc.) that each enable a user to provide one or more inputs to the controller 122. In the illustrated embodiment, the user interface 136 includes one input element 138 in the form of a push-button that can provide multiple different inputs to the controller 122 by varying the length in which the push-button is pressed inward. The user interface 136 can further include one or more indicator elements 140 (e.g., light modules, speakers, displays, etc.) that can be operated by the controller 122 to indicate certain information to a user. In the illustrated embodiment, the user interface 136 includes one indicator element 140 in the form of an LED light module that can be lit in various manners (e.g., persistently, blinking, etc.) to indicate different information to a user.

Figure 8:
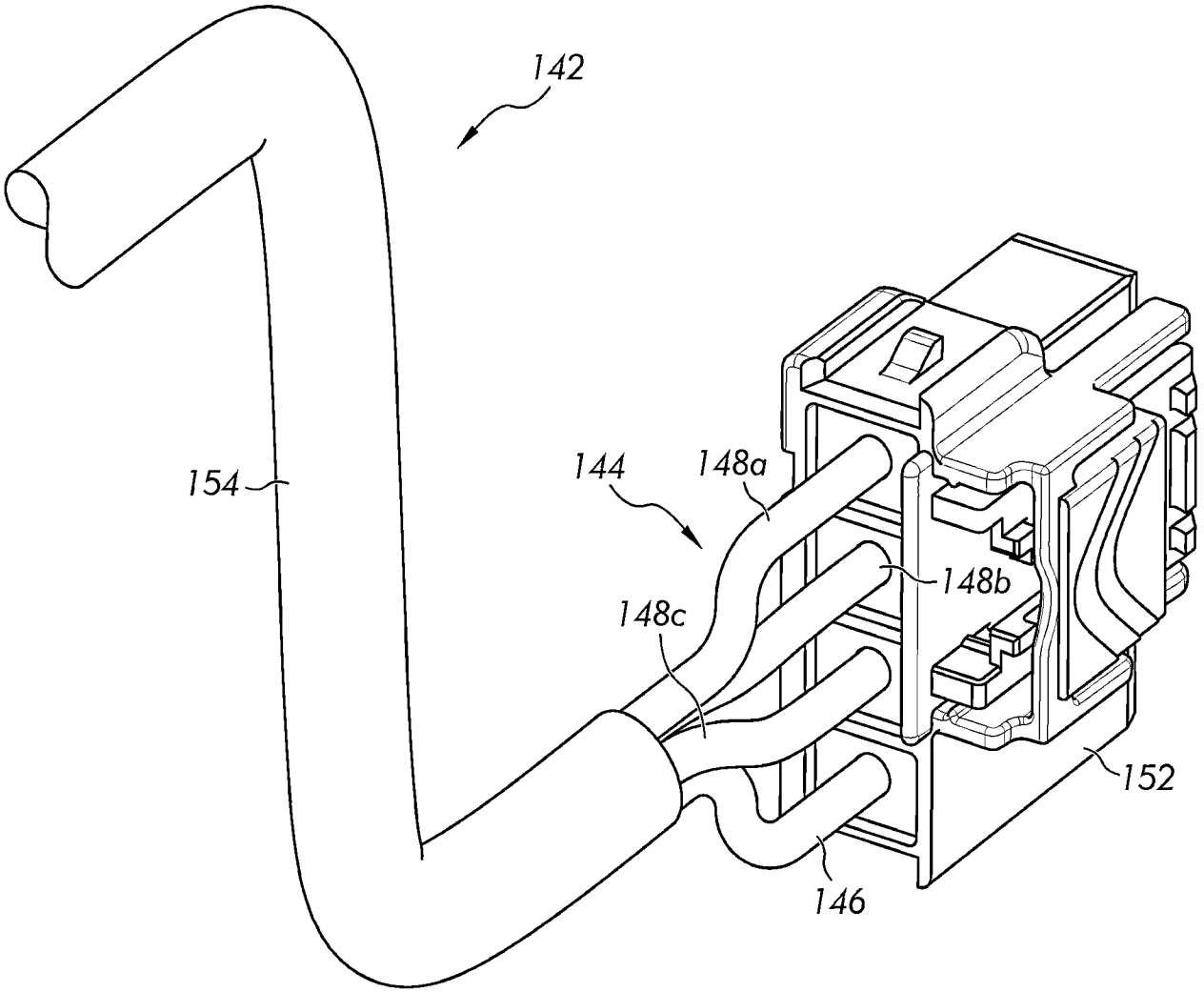
FIG. 8 is a perspective view of a cable assembly of the auxiliary ice maker.

As shown in FIG. 8, the control system 120 of the auxiliary ice maker 80 can further include a cable assembly 142 that is electrically coupled to its controller 122 and can provide communication between the controller 122 and one or more features of the appliance 10. More specifically, the cable assembly 142 can include a power line 144 for transmitting power (e.g., AC or DC power) from the power inlet 48 of the appliance 10 to the controller 122, and one or more control lines 146 for transmitting a control signal from the controller 122 to the appliance 10 (or vice versa).

Each power line 144 and control line 146 of the cable assembly 142 can terminate at one end to the controller 122 and terminate at the other end to a common connector 152, which can be connected to a corresponding connector on the appliance 10 to quickly connect the lines 144, 146 to associated power lines and control lines of the appliance 10. Moreover, the cable assembly 142 can include an insulating sheath 154 that surrounds the lines 144, 146 of the cable assembly 142 and extends at least partially along the lines 144, 146 between the controller 122 and the connector 152.

In the illustrated embodiment, the power line 144 is configured for transmitting AC power from the power inlet 48 of the appliance 10 to the controller 122, and includes a hot wire 148*a*, a neutral wire 148*b*, and a ground wire 148*c*. Moreover, the cable assembly 142 includes a single control line 146 comprising a single wire for transmitting a control signal from the controller 122 to the valve 38 of the appliance's water supply system 30. However, the cable assembly 142 can include additional power lines 144 and/or control lines 146 in other examples, and each line 144, 146 may include one or more wires.

Turning to FIGS. 9-12, example structure and methodology for mounting the auxiliary ice maker 80 in the appliance 10 will now be described. In particular, structure and methodology is described below for removably mounting the ice maker 80 to an upper wall 162 of the appliance's lower-right compartment 18*d*. However, it is to be appreciated that the ice maker 80 can be similarly mounted to a different wall of the same compartment 18*d* (e.g., side wall or rear wall), or to a wall of a different compartment 18. It is even contemplated that the ice maker 80 could be mounted onto a door 22 of the appliance 10.

Figure 9:
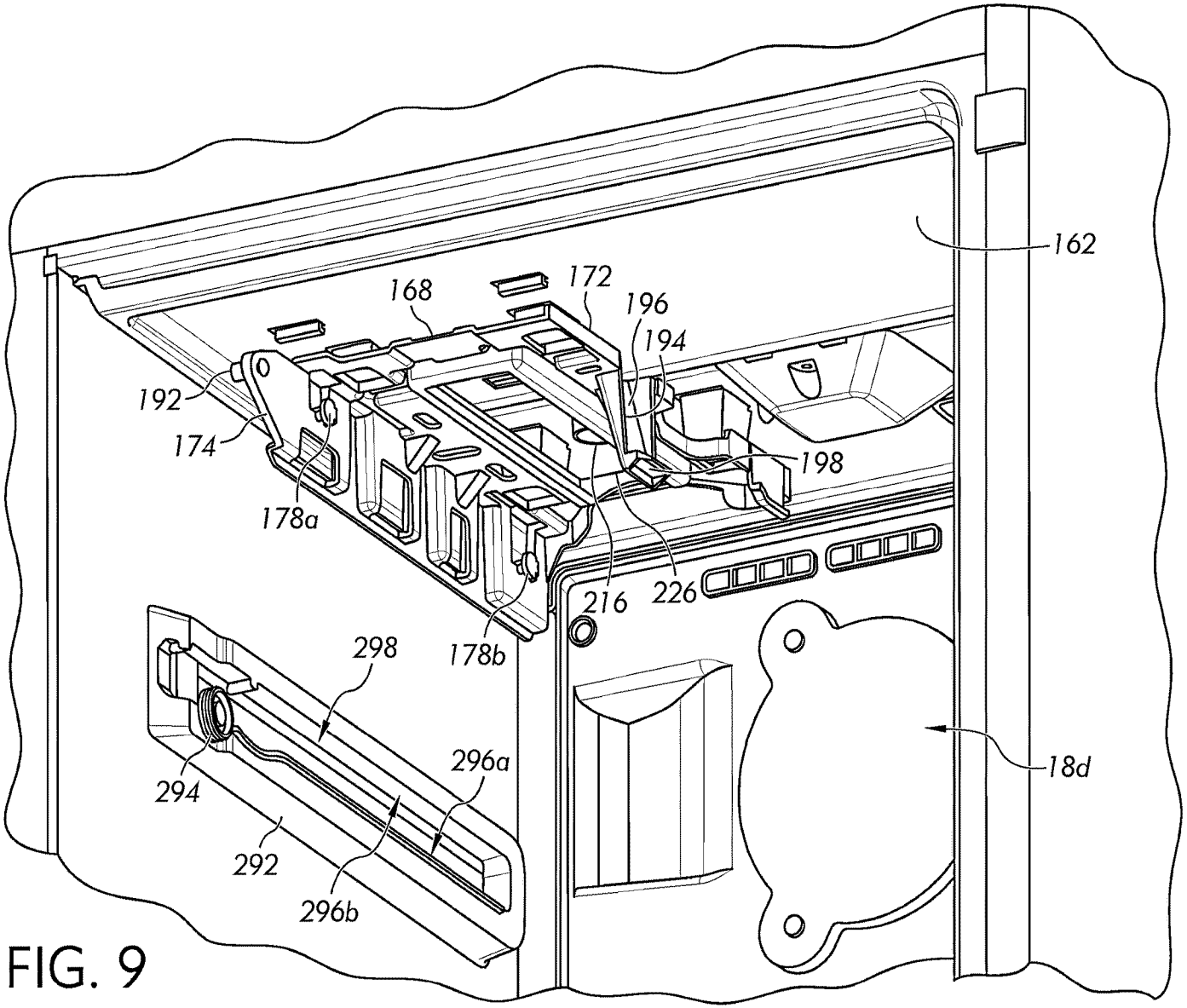
FIG. 9 is an enlarged perspective view of a compartment of the appliance, wherein the auxiliary ice maker and a storage bin for the auxiliary ice maker have been removed for the purposes of illustration.
Figure 10:
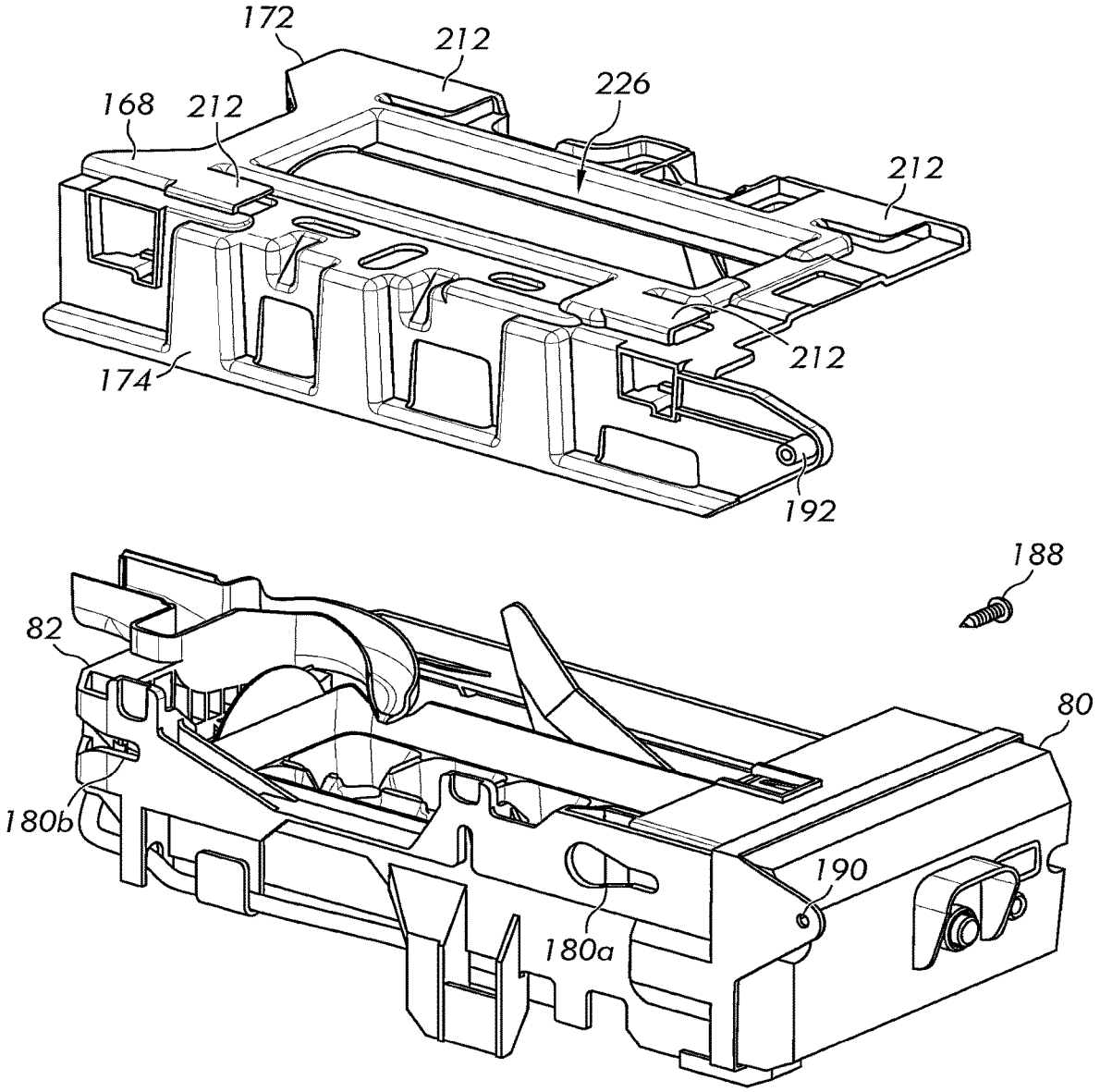
FIG. 10 is an exploded view of the auxiliary ice maker and a support frame for the auxiliary ice maker.
Figure 11:
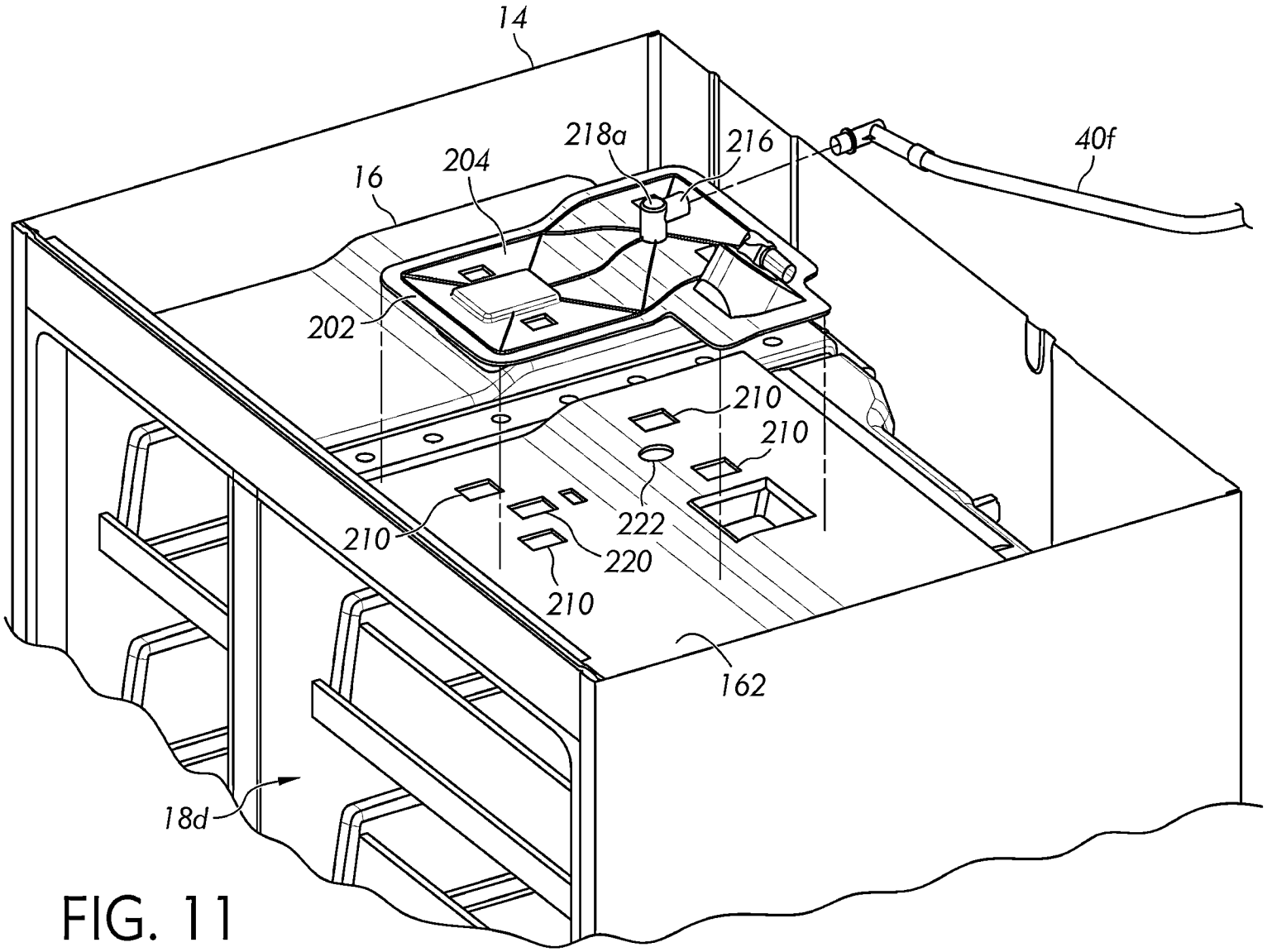
FIG. 11 is a horizontal cross-section view of the appliance, wherein an anchor and water line of the appliance are shown in a removed state.
Figure 12:
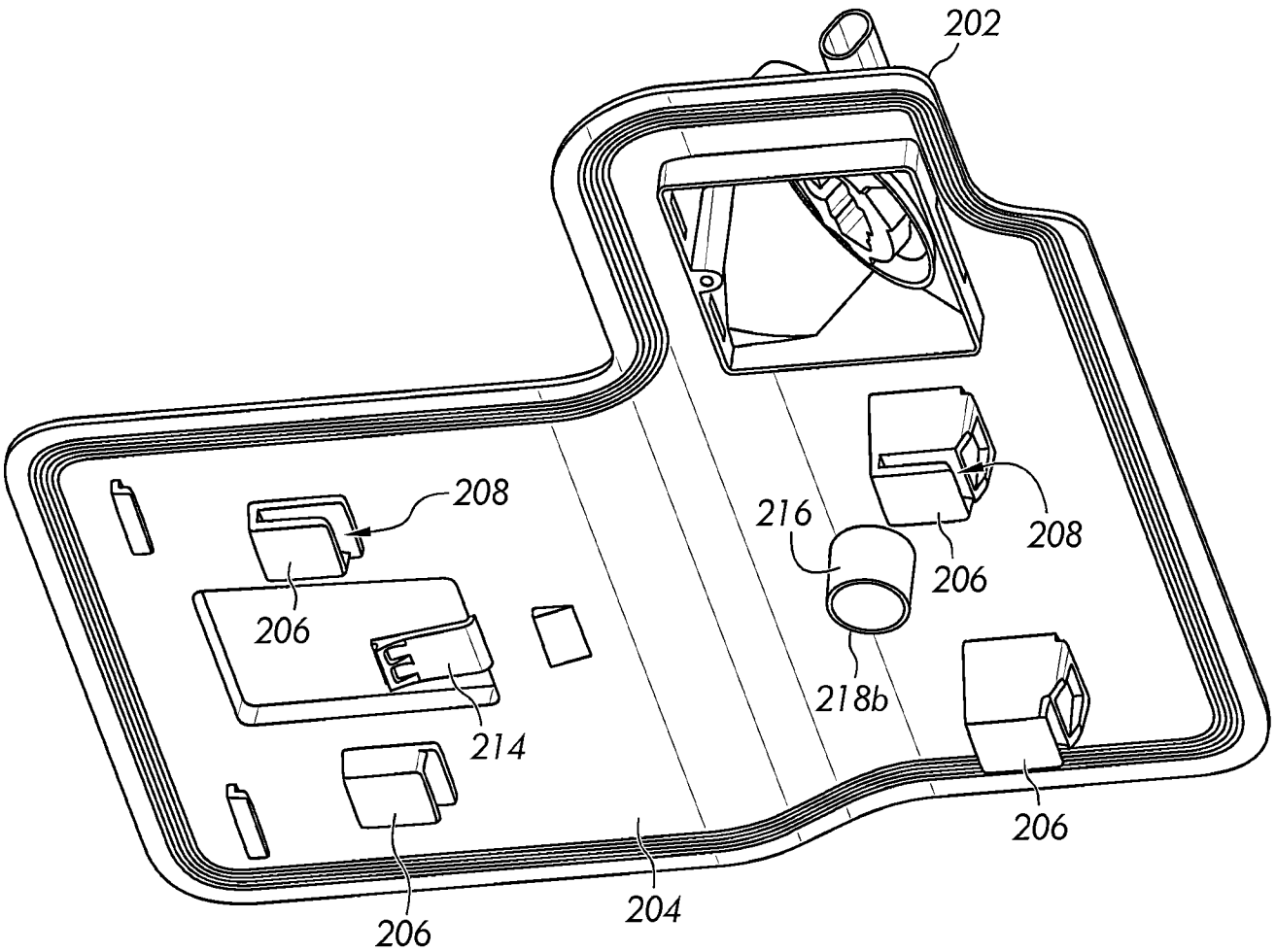
FIG. 12 is a perspective view of the anchor.

As shown in FIGS. 9 & 10, the appliance 10 can include a support frame 168 that can be secured to the upper wall 162 of the lower-right compartment 18*d*. The support frame 168 includes a horizontal member 172 that extends substantially parallel to the upper wall 162 and a vertical member 174 that extends downward from a left side of the horizontal member 172, substantially perpendicular to the upper wall 162.

The support frame 168 further includes first and second mounting projections 178*a*, 178*b* that extend horizontally from the vertical member 174 and can be received within first and second openings 180*a*, 180*b* defined in a left side of the ice maker's carriage 82 to removably mount the ice maker 80 to the support frame 168. More specifically, each mounting projection 178*a*, 178*b* has a shaft and an enlarged head provided at an end of the shaft that is larger in diameter than the shaft. Meanwhile, the first opening 180*a* is a keyhole that extends in a front-rear direction of the carriage 82 such that the opening 180*a* increases in vertical width from a front end to a rear end of the opening 180*a*. Moreover, the second opening 180*b* is a slot that extends horizontally forward from a rear edge of the carriage 82.

In this manner, the ice maker 80 can be removably mounted to the support frame 168 by manipulating its carriage 82 such that the first projection 178*a* of the support frame 168 is received within the rear end of the first opening 180*a*. The ice maker 80 can then be slid rearward such that the shafts of the mounting projections 178*a*, 178*b* move into the front ends of their corresponding openings 180*a*, 180*b*, and the heads of the mounting projections 178*a*, 178*b* hold the mounting projections 178*a*, 178*b* within the openings 180*a*, 180*b* along the lateral (left-right) direction. A threaded fastener 188 can then be inserted through a fastener hole 190 in the carriage 82 as threaded into a threaded bore 192 of the support frame 168 to lock the carriage 82 in place.

In some examples, the support frame 168 can further include a clip 194 that depends downward from a right side of its horizontal member 172 and can vertically support a right side of the ice maker's carriage 82 when mounted to the support frame 168. More specifically, the clip 194 includes a vertical portion 196 that depends downward from the horizontal member 172 of the support frame 168, and a horizontal portion 198 that extends horizontally from a bottom end of the vertical portion 196. When the ice maker 80 in mounted to the support frame 168, the horizontal portion 198 of the clip 194 will vertically support a right side of the ice maker's carriage 82.

It is to be appreciated that the support frame 168 and ice maker 80 can be configured in a variety of alternative manners to facilitate mounting of the ice maker 80 to the support frame 168. For example, the mounting projections 178*a*, 178*b* and openings 180*a*, 180*b* described above can be located on other portions of the support frame 168 and ice maker 80, or can be reversed such that the openings 180*a*, 180*b* are defined in the support frame 168 and the mounting projections 178*a*, 178*b* extend from the carriage 82 of the ice maker 80. As another example, either one or both of the openings 180*a*, 180*b* can be a slot, keyhole, or some other type of opening. Even further, the clip 194 can depend from a different portion of the support frame 168 and support a different side of the ice maker 80, or the clip 194 can be provided on the ice maker 80 to similarly engage the support frame 168 and support the ice maker 80.

In order to secure the support frame 168 to the upper wall 162 of the lower-right compartment 18*d*, the appliance 10 can include an anchor 202 (see FIGS. 11 & 12), which can be arranged on an upper side of the wall 162 and will be permanently installed within a foamed insulation during the manufacturing process. In particular, the anchor 202 will be installed within the mullion that separates the upper fresh food compartment 18*a* from the lower compartments 18*c*, 18*d* of the appliance 10. The anchor 202 includes a plate body 204 and a plurality of coupling bodies 206 that depend downward form the plate body 204. Each coupling body 206 defines a horizontal channel 208 that extends partially into the coupling body 206 from a rear end thereof. Meanwhile, the upper wall 162 defines a plurality of coupling body apertures 210 that the coupling bodies 206 can penetrate through into the compartment 18*d*, and the horizontal member 172 of the support frame 168 defines a plurality of horizontal tabs 212 that can be received within the horizontal channels 208 of the coupling bodies 206 to couple the support frame 168 and anchor 202 together.

The anchor 202 further includes a flexible clip 214 that depends from an underside of the plate body 204 in a downward-forward direction, and a water conduit 216 having an upper portion 218*a* that extends upward from the plate body 204 and a lower portion 218*b* that extends downward from the plate body 204. Moreover, the upper wall 162 of the compartment 18*d* includes a clip aperture 220 and a conduit aperture 222 that the clip 214 and lower portion 218*b* of the water conduit 216 can penetrate through into the into the compartment 18*d*.

In this manner, the support frame 168 can be secured to the upper wall 162 of the compartment 18*d* by first placing the anchor 202 on the upper side of the wall 162 such that its coupling bodies 206, clip 214, and water conduit 216 penetrate through their respective coupling body apertures 210, clip aperture 220, and conduit aperture 222 of the upper wall 162. The support frame 168 can then be manipulated within the compartment 18*d* such that its horizontal tabs 212 enter the rear sides of the horizontal channels 208 of the anchor 202 and are moved horizontally forward until the tabs 212 reach the forward ends of the channels 208 and further forward movement is inhibited by the coupling bodies 206. During this movement, the flexible clip 214 of the anchor 202 will be flexed upward by the support frame 168 until the support frame 168 reaches its final position (see FIG. 9) and an opening 226 in the horizontal member 172 of the support frame 168 permits the flexible clip 214 to flex back downward and engage a front edge of the opening 226, thereby inhibiting future rearward movement of the support frame 168. When coupled in this manner, the support frame 168 will be secured against the upper wall 162. Moreover, the water conduit 216 will penetrate through or be directly above the opening 226 of the support frame 168, such that an outlet of the water conduit 216 is directly above the ice mold 84 of the ice maker 80 and can feed water into the cavities 86 of the ice mold 84 below.

It is to be appreciated that the support frame 168 and anchor 202 can be configured in a variety of alternative manners to facilitate mounting of the support frame 168 to the upper wall 162 of the compartment 18*d*. For example, the coupling bodies 206 and horizontal tabs 212 can be reversed such that the coupling bodies 206 are provided on the support frame 168 and the horizontal tabs 212 are provided by the anchor 202. As another example, the direction/orientation of the horizontal channels 208 and horizontal tabs 212 can be modified such that the horizontal tabs 212 are moved rearward or laterally into the horizontal channels 208 to couple the support frame 168 and anchor 202 together. Even further, the flexible clip 214 of the anchor 202 can be configured to engage a different edge of the opening 226 and prevent a different direction of movement of the support frame 168 (e.g., lateral or forward).

Referring back to FIG. 3, the ice maker 80 can be fluidly coupled to the water supply system 30 of the appliance 10 via water line 40*f*. In particular, the water line 40*f* can feed water into the water conduit 216 of the anchor 202 described above, which will convey the water to the ice mold cavities 86 of the ice maker 80. Moreover, the connector 152 of the ice maker's cable assembly 142 can be connected to a connector 230 provided on the appliance 10 (e.g., within the compartment lower-right 18*d*) to electrically connect the power line 144 and control line 146 of the cable assembly 142 to a power line 50*b* and control line 54*b* of the appliance 10, respectively.

Figure 13:
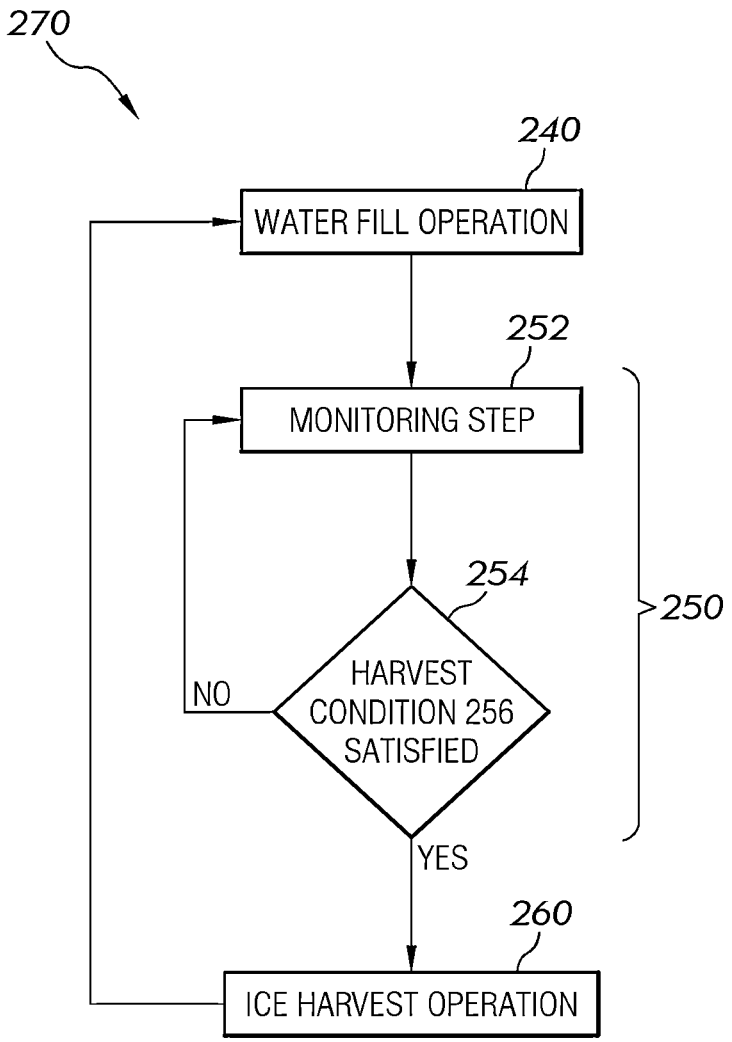
FIG. 13 schematically illustrates various operations for the auxiliary ice maker.

Turning to FIG. 13, various operations are illustrated that can be programmed into the controller 122 of the ice maker 80, which can control and/or communicate with various features of the ice maker 80 and appliance 10 to perform the operations automatically. In particular, FIG. 13 shows a water fill operation 240, a determining operation 250, and an ice harvest operation 260, which form a main operating cycle 270 for the ice maker 80. The controller 122 can be configured such that upon startup of the ice maker 80, the ice maker 80 will enter this main operating cycle 270 (e.g., at the water fill operation 240) with the ice mold 84 at its home position. In addition or alternatively, the controller 122 can be configured to perform one or more of the operations automatically in response to an input (e.g., a start command) provided manually by a user to the controller 122 via the user interface 136, and/or some other input to the controller 122 (e.g., an output of a sensor assembly).

The water fill operation 240 comprises selectively providing an output signal (e.g., positive or zero voltage) to the control line 146 of the cable assembly 142 for a predetermined amount of time. As noted above, the control line 146 of the cable assembly 142 can be connected to the control line 54*b* of the appliance 10 (see FIG. 3), which is connected to the triple valve 38 of the appliance's water supply system 30. The output signal provided to the control line 146 during the water fill operation 240 can be to a positive voltage (e.g., 85-265 VAC at 50-60 Hz), and will actuate (i.e., open) the solenoid 46 of the valve 38 associated with the water line 40*f* for the ice maker 80, thereby supplying water to the ice maker 80. The predetermined amount of time in which the output signal is provided can vary in different embodiments, but will preferably correspond to the length of time required to fill the cavities 86 of the ice mold 84 with water when the cavities 86 are completely empty.

Once the cavities 86 of the ice mold 84 have been filled by the water fill operation 240, the water can be cooled to a frozen state and then harvested by the ice harvest operation 260 discussed further below. However, before proceeding to the ice harvest operation 260, the controller 122 can perform a determining operation 250 in response to completion of the water fill operation 240. The determining operation 250 includes a monitoring step 252 of monitoring one or more parameters of the ice maker 80, and a determining step 254 of determining if a harvest condition 256 is satisfied by the parameter(s) monitored during the monitoring step 252 indicating that ice in the ice mold 84 is ready to be harvested.

For example, the monitoring step 252 can include monitoring the temperature of the water in the ice mold 84 detected by the temperature sensor 130 disposed upon the ice mold 84 (e.g., the resistance of the temperature sensor 130, which corresponds to its temperature). Moreover, the harvest condition 256 can include a temperature condition requiring that the temperature sensor 130 detects a temperature equal to or below a predetermined temperature (e.g., −7° C. or less), and then a predetermined amount of time (e.g., 3 minutes or more) elapses. However, the temperature condition may vary in different embodiments. For instance, the temperature condition may require a different predetermined temperature and/or predetermined amount of time. Moreover, the temperature condition may not require a predetermined amount of time to elapse upon detection of a temperature equal to or below the predetermined temperature. Still further, the temperature condition may require additional conditions than those described above.

In addition or alternatively, the monitoring step 252 can include monitoring the output of the sensor assembly 124 described above, which will indicate whether the detection lever 108 is in a predetermined position (e.g., extended position or retracted position). Moreover, the harvest condition 256 can require that the monitored output of the sensor assembly 124 indicates that ice should be harvested. For instance, in embodiments wherein the predetermined position of the detection lever 108 corresponds to its extended position, the harvest condition 256 can require that the output of the sensor assembly 124 indicates that the detection lever 108 assumes the predetermined position during the monitoring step 254. Meanwhile, in embodiments wherein the predetermined position of the detection lever 108 corresponds to its retracted position, the harvest condition 256 can require that the output of the sensor assembly 124 indicates that the detection lever 108 does not assume the predetermined position during the monitoring step 254.

If the determining step 254 determines that the harvest condition 256 is not satisfied during the monitoring step 252, the controller 122 can restart the determining operation 250. Conversely, if the determining step 254 determines that the harvest condition 256 is satisfied, the controller 122 can initiate and perform the ice harvest operation 260. The ice harvest operation 260 can include moving the ice mold 84 from its home position toward its harvest position, completing movement of the ice mold 84 to its harvest position to harvest ice, and then returning the ice mold 84 back to the home position so that more ice can be prepared. The controller 122 can perform the ice harvest operation 260 by operating the motor 92 of the drive assembly 90 to move the ice mold 84 accordingly.

In some examples, the controller 122 can be configured to initiate the water fill operation 240 in response to completion of the ice harvest operation 260, thereby restarting the main operating cycle 270 of the ice maker 80. However, in other examples, the main operating cycle 270 may terminate upon completion of the ice harvest operation 260.

Various operations of the ice maker 80 have been described above. It is to be appreciated that each operation can comprise additional and/or alternative steps than those described above, and can exclude one or more of the steps described above. Moreover, one or more of the operations (or steps within the operations) can be performed manually by a user, with no assistance from the controller 122.

Some operations of the ice maker 80 are described and claimed herein as performing a certain action "if" a certain condition occurs or "in response to" a certain condition, wherein the condition comprises one or more terms. Such a conditional action as described and claimed herein means that performance of the action is conditional on the existence of its corresponding condition, rather than incidental with the existence of its corresponding condition. Moreover, the corresponding condition is open-ended, meaning that the corresponding condition may include additional terms than those described and claimed. Still further, there may be separate operations that perform the same action, either conditionally or non-conditionally. For example, an operation that performs action X "if" or "in response to" condition Y requiring term Z means that performance of action X is conditional on the existence of condition Y, and that condition Y may require one or more terms in addition to term Z. Moreover, there may be a separate operation that performs action X, either conditionally or non-conditionally.

The ice maker 80 as described above has a "self-contained" control system 120, meaning that the components of the control system 120 are all supported by the carriage 82 of the ice maker 80 and the only outside input to the control system 120 is power (e.g., from the appliance 10 via the power line 144 of the cable assembly 142). In this manner, the ice maker 80 can be a modular unit that is easily installed in (or removed from) the appliance 10 without having to connect the control system 120 with (or disconnect the control system 120 from) several control devices in the appliance 10.

That is, the ice maker 80 can be installed by simply mounting the ice maker 80 to the support frame 168 as described above and connecting the power line 144 and control line 146 of the cable assembly 142 to the power line 50*b* and control line 54*b* of the appliance 10 (via connection of the cable assembly's connector 152 to the appliance's connector 228). Moreover, the ice maker 80 can be removed by simply removing the ice maker 80 from the support frame 168 and disconnecting the power line 144 and control line 146 of the cable assembly 142 from the power line 50*b* and control line 54*b* of the appliance 10.

Accordingly, the ice maker 80 can be easily installed in (or removed from) the appliance 10 to adjust the ice capacity of the appliance 10 as desired. Moreover, because the ice maker 80 has a self-contained control system 120, the appliance 10 itself does not have be equipped with control devices such as a controller or sensor assembly that are specific to the ice maker 80, and therefore can be universally manufactured for use with various different auxiliary ice makers.

It is to be appreciated that the primary ice maker 24 can be configured similarly to the auxiliary ice maker 80 described above. Moreover, the primary ice maker 24 can be similarly mounted within a compartment 18 of the appliance 10 using the support frame 168 and anchor 202 described above. However, generally speaking, the primary and auxiliary ice makers 24, 80 can comprise any configuration for making ice pieces, and can be mounted within a compartment 18 of the appliance 10 in a variety of different ways.

Figure 14:
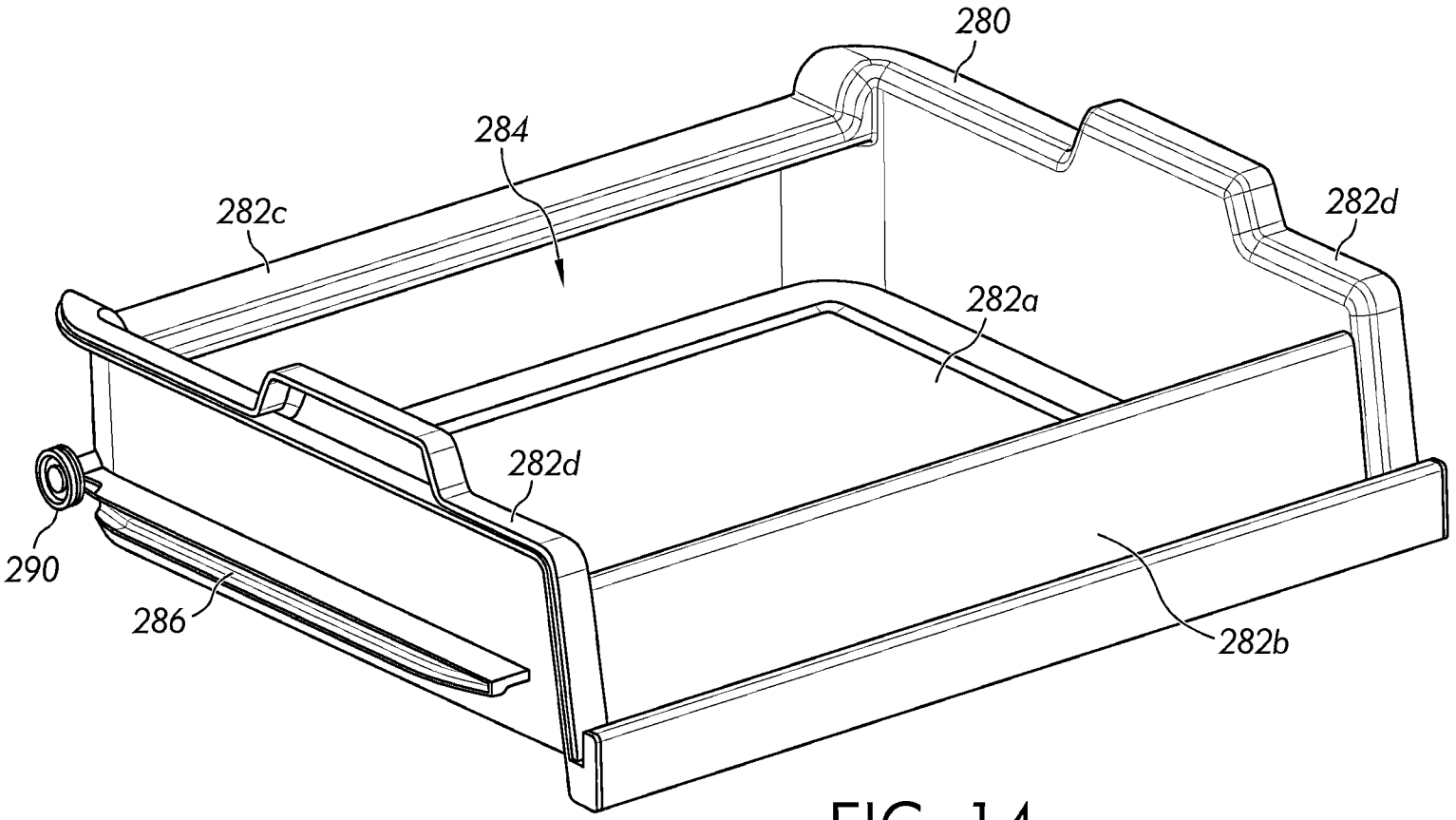
FIG. 14 is a perspective view of the ice bin for the auxiliary ice maker.

Turning to FIG. 14, an example ice bin 280 is illustrated that can be slidably mounted within a suitable compartment 18 and located below the ice maker 80 described above. The ice bin 280 includes a bottom wall 282*a*, a front wall 282*b*, a rear wall 282*c*, and a pair of side walls 282*d* that collectively define a storage space 284 for receiving and storing ice pieces harvested from the ice maker 80.

To slidably mount the ice bin 280, a longitudinal rib 286 can be provided on each side wall 282*d* of the ice bin 280 that extends longitudinally in the forward-rearward direction. Moreover, a rear roller 290 can be provided at a rear end of each rib 286. Meanwhile, as shown in FIG. 9, a guide track 292 can be provided on each side wall of the compartment 18 in which the ice bin 280 is mounted (e.g., lower-right compartment 18*d*), and a front roller 294 can be provided at a front end of each guide track 292. Each guide track 292 has upper and lower surfaces 296*a*, 296*b* that define a longitudinal channel 298 therebetween.

In this manner, the ice bin 280 can be slidably mounted by inserting its rear rollers 290 into the longitudinal channels 298 of the compartment's guide tracks 292, and resting the longitudinal ribs 286 of the ice bin 280 on the front rollers 294 of the compartment 18. The front rollers 294 of the compartment 18 will support the longitudinal ribs 286 of the ice bin 280, while the guide tracks 292 of the compartment 18 will restrict vertical movement of the ice bin's rear rollers 290, thereby keeping the ice bin 280 level.

Figure 15:
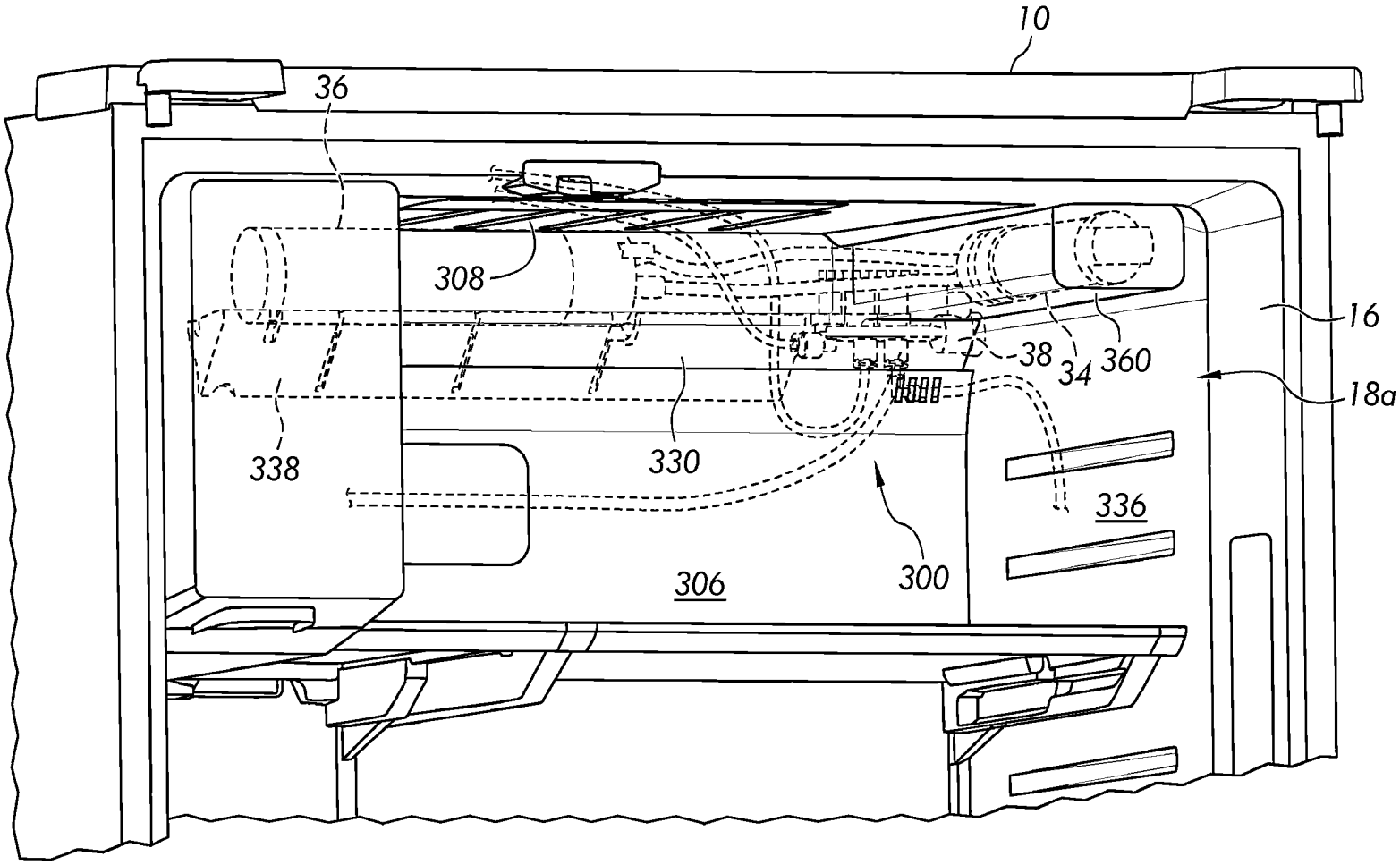
FIG. 15 is a close-up perspective view of an upper compartment of the appliance.
Figure 16:
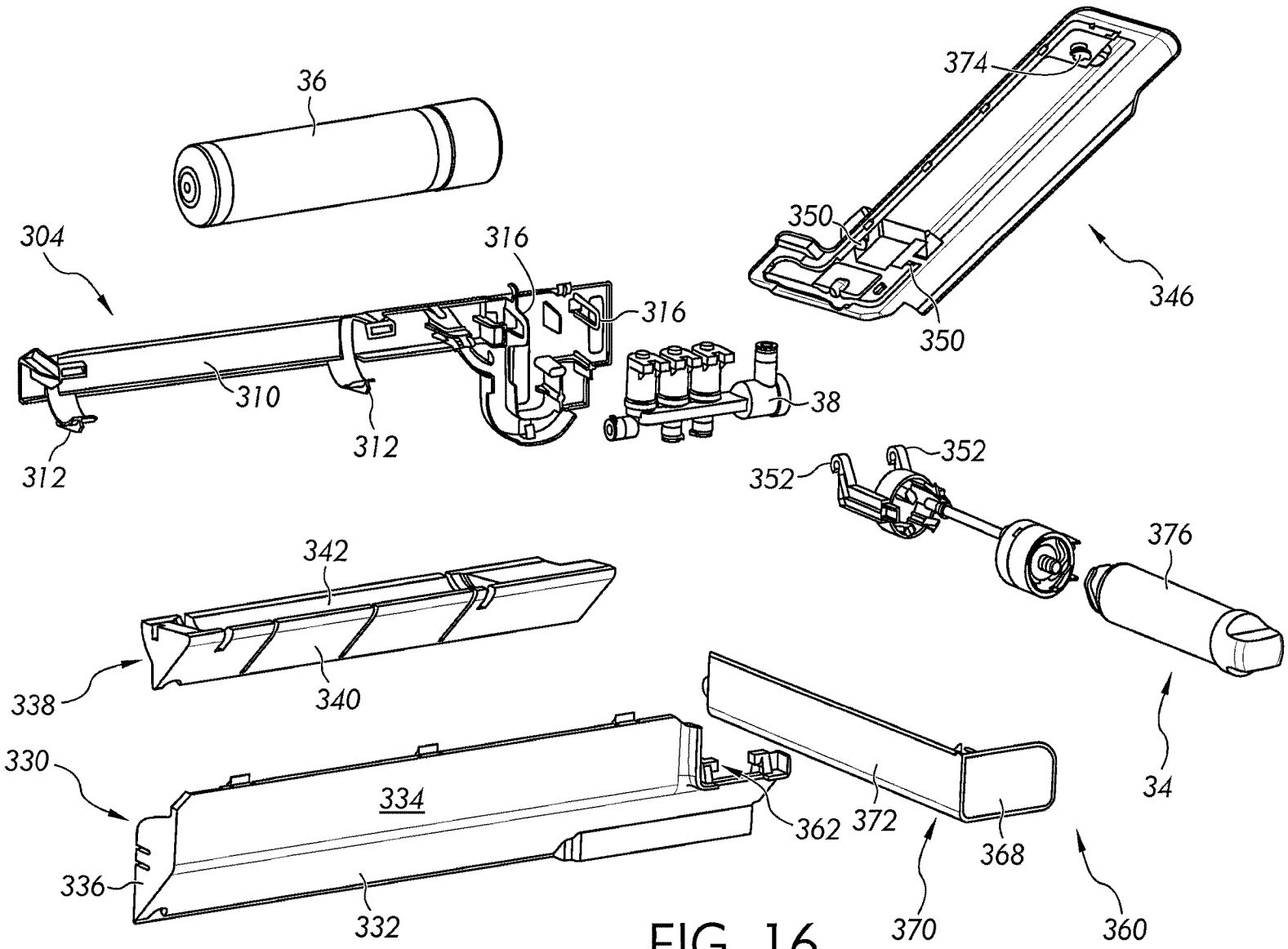
FIG. 16 is an exploded view of a mounting system for a water tank, water filter, and valve of the appliance.
Figure 17:
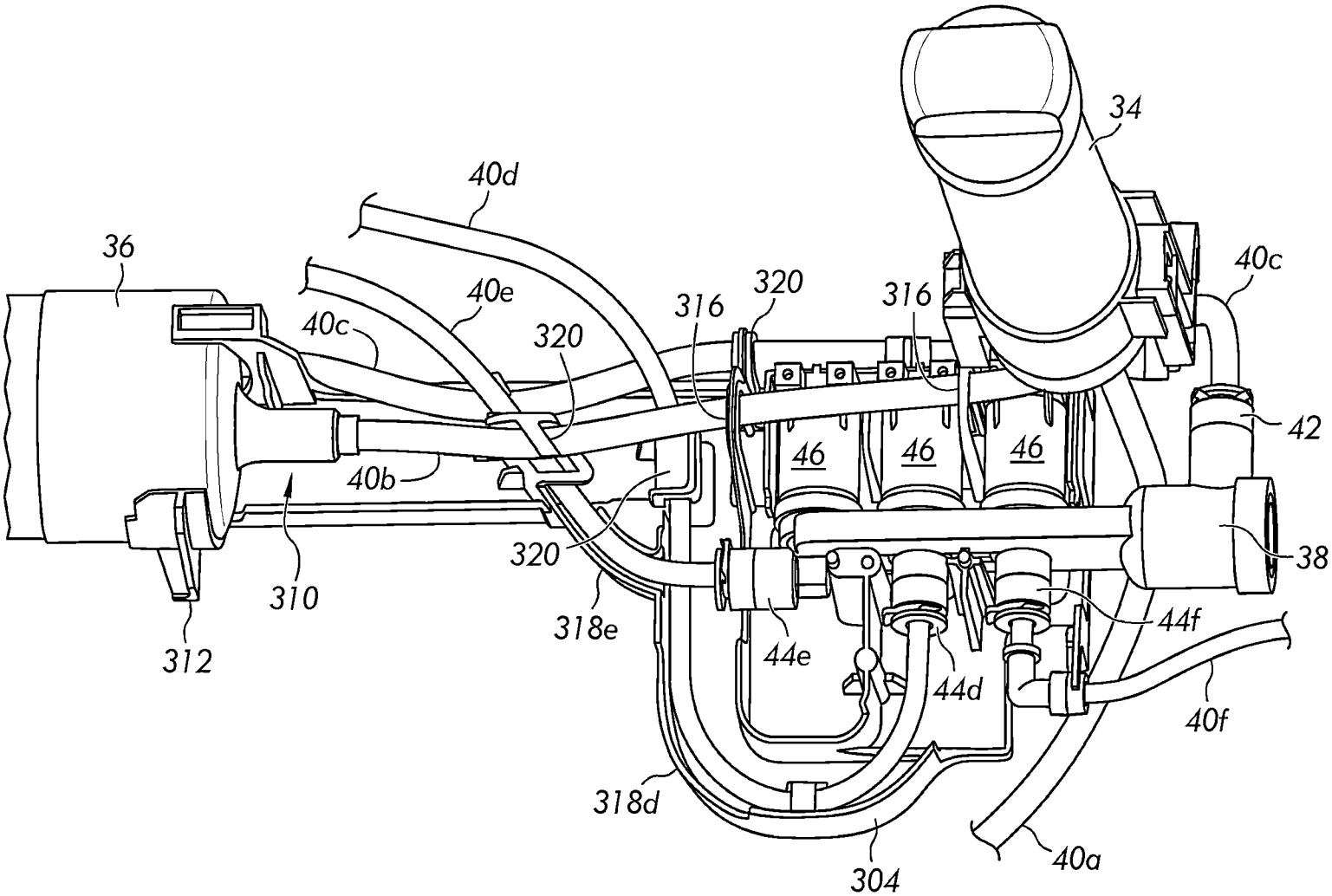
FIG. 17 is an isolated view of the water tank, the water filter, the valve, and a bracket of the mounting system in a mounted state.

Turning to FIGS. 15-17, a mounting system 300 will now be described for mounting the water filter 34, water storage tank 36, and triple valve 38 of the appliance 10 within the upper compartment 18*a* of the liner 16. However, it is to be appreciated that the mounting system 300 can be similarly adapted to mount the water filter 34, water storage tank 36, and triple valve 38 within an alternative compartment (e.g., lower-right compartment 18*d*) of the liner 16.

The mounting system 300 includes a mounting bracket 304 (see FIGS. 16 & 17) for the water storage tank 36 and triple valve 38 that can secured to a rear wall 306 of the compartment 18*a*, just below a top wall 308 of the compartment 18*d*. The bracket 304 can be secured by screws, although other securing means (e.g., adhesive, hook and loop type fastener, tab/slot configurations, etc.) can be used to secure the bracket 304. Alternatively, the bracket 304 can be integrally formed with the rear wall 306 of the compartment 18*a* during a molding operation of the liner 16.

The bracket 304 has a front surface 310 with at least one arm 312 extending outwards therefrom for securing the water storage tank 36 to the bracket 304. Moreover, the bracket 304 includes a pair of opposing clips 316 extending outwards from the front surface 310 for securing the valve 38 to the bracket 304. The clips 316 are elastically deformable such that, when the valve 38 is in an installed position, each clip 316 exerts a force on a portion (e.g., solenoid 46) of the valve 38 toward the opposing clip 316 to removably secure the valve 38 to the bracket 304. However, other attachment structure (e.g., screws, adhesives, etc.) may alternatively be used to attach the valve 38 to the bracket 304

The bracket 304 can further include one or more guide walls 318 for guiding water line(s) 40 to/from the water filter 34, water storage tank 36, and/or triple valve 38. For example, in the illustrated embodiment, the bracket 304 includes two guide walls 318*d*, 318*e* for respectively guiding the water lines 40*d*, 40*e* that connect the outlets 44*d*, 44*e* of the valve 38 to the primary ice maker 24 and dispenser 56. Each guide wall 318 can have a predetermined curvature that corresponds to a radial bend of its associated water line 40. This curvature can promote a natural shaping of the water line 40 in an installed position to provide strain relief without exerting unnecessary forces on the water line 40. In this manner the integrity of an outer circumferential surface of the water line 40 is preserved and reoccurring replacement of the water line 40 is less likely to occur.

In some examples, the bracket 304 can further include one or more retaining mechanisms 320 for securing water line(s) 40 to the bracket 304. Each retaining mechanism 320 can be, for example, a hook that snaps onto a water line 40, or a ring that a water line 40 can be fed through. The retaining mechanisms 320 can be formed integrally with the bracket 304 or separately attached thereto.

The mounting system 300 further includes a first housing 330 that can be secured to the liner 16 in a covering relationship over the bracket 304 and water storage tank 36 so as to enclose the bracket 304 and the water storage tank 36 within the compartment 18*a*. Specifically, the first housing 330 can be secured to the rear wall 306 and/or top wall 308 of the liner 16 (e.g., using tabs, hooks, fasteners, etc.), and includes a bottom wall 332, a front wall 334 positioned parallel to the rear wall 306 of the liner 16, and at least one side wall 336 being perpendicular to the front wall 334. Due to this configuration, the first housing 330 acts as a cover that can be efficiently attached to and removed from the liner 16 to provide selective access to the bracket 304 and water storage tank 36.

In some examples, the mounting system 300 can include an insulation member 338 that can be positioned within the first housing 330 adjacent to the water storage tank 36. Specifically, the insulation member 338 can be positioned between the water storage tank 36 and the bottom wall 121 of the first housing 330, and includes a bottom surface 340 and a top surface 342 that can be shaped to respectively mate with the bottom wall 332 of the first housing 330 and a peripheral surface of the water storage tank 36. In this way, the water storage tank 36 can rest partially recessed into the insulation member 338, which can help to ensure that the temperature of the water storage tank 36 stays fairly consistent over time, and also that the water does not freeze inside the water storage tank 36.

The mounting system 300 can further include a mounting panel 346 for mounting the water filter 34, which can secured to the top wall 308 of the compartment 18*a*. The panel 346 can be secured by screws, although other securing means (e.g., adhesive, hook and loop type fastener, tab/slot configurations, etc.) can be used to secure the panel 346. Alternatively, the panel 346 can be integrally formed with the top wall 308 of the compartment 18*a* during a molding operation of the liner 16.

The panel 346 includes a bar 350 that is spaced vertically below a lower surface of the panel 346 and extends between opposing inner surfaces of the panel 346. The bar 350 may extend continuously between the opposing inner surfaces of the panel 346 or, alternatively, an intervening structure may exist between the opposing inner surfaces of the panel 346 such that the bar 350 is sectioned into first and second bars. In addition, the bar 350 may be integrally formed with the panel 346 or, alternatively, may be separately manufactured and subsequently installed within the panel 346.

The water filter 34 can include a pair of arms 352 that can be hooked around the bar 350 of the panel 346 to install the water filter 34. Such an engagement between the arms 352 and the bar 350 defines a pivot point such that the water filter 34 can rotate about the bar 350 between an up position and a down position. In the up position, a longitudinal axis of the water filter 34 will be parallel to the top wall 308 of the liner 16. Meanwhile, in the down position, the longitudinal axis of the water filter 34 will slope downward along the rear-to-front direction of the appliance 10. Optionally, the water filter 34 may be biased (e.g., by a spring, not shown) in the up position, and a user can rotate the water filter 34 to the down position by applying a downward force to the water filter 34 (i.e., greater than the biasing force of the spring).

The mounting system 300 can further include a second housing 360 that can be pivotally connected to the first housing 330 such that the second housing 360 can likewise be rotated between an up position and a down position. More specifically, the first housing 330 can include a pair of laterally spaced rotation pins 362 that face one another and are positioned on the first housing 330 at an end closest to a right-side wall 364 of the liner 16. Meanwhile, the second housing 360 can include a pair of arms that can hook onto the pins 362 to pivotally connect the second housing 360 to the first housing 330.

The second housing 360 includes a front wall 368, a bottom wall 370, and a side wall 372 that will lie respectively parallel to the rear wall 306, top wall 308, and side wall 342 when the second housing 360 is in the up position. Moreover, the second housing 360 can include latching structure that can latch onto an anchor 374 of the panel 346 to hold the second housing 360 in the up position. To move the second housing 360 to its down position, a user can move (e.g., pull or push) the second housing 360 slightly laterally (e.g., forward, rearward, sideways) until the latching structure is released from the anchor 374 and the second housing 360 can rotate downward about the pins 362 of the first housing 330.

When the second housing 360 is in the up position, the second housing 360 will act as a cover for the water filter 34 so as to enclose the water filter 34 within the compartment 18*a*. Additionally, the first and second housings 330, 340 will collectively conceal the bracket 304 and valve 38 from view. Meanwhile, when the second housing 360 is in the down position, a user will be able to access the water filter 34, which can enable a user to, for example, replace a filter element 376 of the water filter 34.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

The invention claimed is:

1. A refrigerator appliance comprising:

a cabinet defining a plurality of compartments;

a primary ice maker mounted within a first compartment of the plurality of compartments;

an auxiliary ice maker removably mounted within a second compartment of the plurality of compartments;

a support frame configured to removably mount the auxiliary ice maker within the second compartment;

wherein the support frame includes:

a horizontal member extending substantially parallel to an upper wall of the second compartment, wherein the horizontal member is secured to the upper wall of the second compartment, a vertical member that extends downward from the horizontal member substantially perpendicular to the upper wall, and first and second mounting projections that extend horizontally from the vertical member and are configured to be respectively received within first and second openings defined in a carriage of the auxiliary ice maker, and an anchor configured to secure the support frame to the upper wall of the second compartment, wherein the anchor and the support frame are arranged on opposite sides of the upper wall of the second compartment, wherein the anchor and the support frame are secured to one other with the upper wall therebetween, wherein the anchor includes a plate body and plurality of coupling bodies, wherein the plurality of coupling bodies extend from the plate body and through a plurality of coupling body apertures in the upper wall of the second compartment, and wherein the support frame includes a plurality of tabs that are received within channels defined by the plurality of coupling bodies to secure the support frame and anchor to one another.

2. The refrigerator appliance of claim 1, wherein the anchor includes a water conduit for feeding water to an ice mold of the auxiliary ice maker, and wherein the water conduit extends through a water conduit aperture in the upper wall of the second compartment into the second compartment such that an outlet of the water conduit is located directly above the ice mold of the auxiliary ice maker.

3. The refrigerator appliance of claim 1, wherein the anchor includes a flexible clip that extends downwards from an underside of the anchor, wherein the flexible clip extends through a clip aperture in the upper wall of the second compartment into the second compartment.

4. The refrigerator appliance of claim 3, wherein the flexible clip is configured to engage an opening in the support frame such that rearward movement of the support frame is inhibited.

5. The refrigerator appliance of claim 1, wherein each of the first and second mounting projections includes a shaft and an enlarged head provided at an end of the shaft that is larger in diameter than the shaft.

6. The refrigerator appliance of claim 1, wherein each of the first and second mounting projections that extend horizontally from the vertical member are spaced apart and separate from the horizontal member of the support frame.

7. A refrigerator appliance comprising:

a cabinet defining a plurality of compartments;

a primary ice maker mounted within a first compartment of the plurality of compartments;

an auxiliary ice maker removably mounted within a second compartment of the plurality of compartments;

a support frame configured to removably mount the auxiliary ice maker within the second compartment;

wherein the support frame includes:

a horizontal member extending substantially parallel to an upper wall of the second compartment, wherein the horizontal member is secured to the upper wall of the second compartment, a vertical member that extends downward from the horizontal member substantially perpendicular to the upper wall, and first and second mounting projections that extend horizontally from the vertical member and are configured to be respectively received within first and second openings defined in a carriage of the auxiliary ice maker, wherein each of the first and second mounting projections includes a shaft and an enlarged head provided at an end of the shaft that is larger in diameter than the shaft.

* * * * *